US007728827B2

(12) United States Patent
Shin

(10) Patent No.: US 7,728,827 B2
(45) **Date of Patent: *Jun. 1, 2010**

(54) DISPLAY DEVICE USING DEMULTIPLEXER AND DRIVING METHOD THEREOF

(75) Inventor: Dong-Yong Shin, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 913 days.

This patent is subject to a terminal disclaimer.

(21) Appl. No.: 10/997,485

(22) Filed: Nov. 22, 2004

(65) Prior Publication Data

US 2005/0140666 A1 Jun. 30, 2005

(30) Foreign Application Priority Data

Nov. 27, 2003 (KR) ..... 10-2003-0085077

(51) Int. Cl.
*G09G 5/00* (2006.01)

(52) U.S. Cl. ..... 345/204; 345/98

(58) Field of Classification Search ..... 345/87–102, 345/204

See application file for complete search history.

(56) References Cited

U.S. PATENT DOCUMENTS 4,447,812 A 5/1984 Soneda et al.
5,426,447 A * 6/1995 Lee ..... 345/103
5,510,807 A 4/1996 Lee et al.
5,555,001 A 9/1996 Lee et al.
5,633,653 A 5/1997 Atherton
5,708,454 A 1/1998 Katoh et al.
5,892,493 A 4/1999 Enami et al.
6,097,362 A 8/2000 Kim
6,333,729 B1 12/2001 Ha
6,348,906 B1 2/2002 Dawson et al.
6,359,608 B1 3/2002 Lebrun et al.

(Continued)

FOREIGN PATENT DOCUMENTS

CN 1116454 A 2/1996

(Continued)

OTHER PUBLICATIONS

Chinese Office action for corresponding China Patent Application 2005100738191, indicating relevance of CN 1447302 and JP 2004-29755 listed in this IDS.

(Continued)

*Primary Examiner*—Nitin Patel
(74) *Attorney, Agent, or Firm*—Christie, Parker & Hale, LLP

(57) ABSTRACT

Disclosed is a display device using a demultiplexer. The demultiplexer sequentially samples data currents that are multiplexed and applied by a data driver, and holds currents corresponding to the sampled data currents to a plurality of data lines. Since the demultiplexer is to sample the data currents corresponding to N data lines during a horizontal period when performing 1:N demultiplexing, the data current corresponding to one data line is to be sampled during a 1/N horizontal period. A signal line coupled between the demultiplexer and the data driver is precharged with a precharge current before sampling the data current. According to one embodiment, the precharge current is M times the data current, where M is a real number greater than 1.

26 Claims, 17 Drawing Sheets

U.S. PATENT DOCUMENTS

| | | | | |
|---|---|---|---|---|
| 6,559,836 | B1 | 5/2003 | Mori | |
| 6,667,580 | B2 | 12/2003 | Kim et al. | |
| 6,731,266 | B1 | 5/2004 | Jung | |
| 6,771,028 | B1 | 8/2004 | Winters | |
| 7,015,882 | B2 | 3/2006 | Yumoto | |
| 7,038,652 | B2 | 5/2006 | Kang et al. | |
| 7,193,619 | B2 | 3/2007 | Kimura | |
| 7,253,665 | B2 | 8/2007 | Kimura | |
| 7,256,756 | B2 | 8/2007 | Abe | |
| 7,310,092 | B2 | 12/2007 | Imamura | |
| 7,324,079 | B2 | 1/2008 | Tobita | |
| 7,342,559 | B2 | 3/2008 | Shin | |
| 7,403,176 | B2 | 7/2008 | Chung et al. | |
| 7,468,718 | B2 | 12/2008 | Shin | |
| 7,505,017 | B1 * | 3/2009 | Yeo et al. | 345/88 |
| 2003/0030602 | A1 | 2/2003 | Kasai | |
| 2003/0107561 | A1 | 6/2003 | Uchino et al. | |
| 2003/0132907 | A1 | 7/2003 | Lee et al. | |
| 2003/0179164 | A1 | 9/2003 | Shin et al. | |
| 2004/0032382 | A1 | 2/2004 | Cok et al. | |
| 2004/0056852 | A1 | 3/2004 | Shih et al. | |
| 2004/0227749 | A1 | 11/2004 | Kimura | |
| 2004/0239603 | A1 * | 12/2004 | Toriumi et al. | 345/89 |
| 2005/0110727 | A1 | 5/2005 | Shin | |
| 2005/0116919 | A1 * | 6/2005 | Shin | 345/100 |
| 2005/0117611 | A1 * | 6/2005 | Shin | 370/536 |
| 2005/0264495 | A1 * | 12/2005 | Shin | 345/76 |

FOREIGN PATENT DOCUMENTS

| | | | |
|---|---|---|---|
| CN | 1301377 | A | 6/2001 |
| CN | 1417771 | A | 5/2003 |
| CN | 1432989 | A | 7/2003 |
| CN | 1447302 | A | 10/2003 |
| CN | 1488131 | | 4/2004 |
| GB | 2 384 102 | A | 7/2003 |
| JP | 02-306293 | | 12/1990 |
| JP | 06-118913 | | 4/1994 |
| JP | 2000-122607 | | 4/2000 |
| JP | 2000-356978 | | 12/2000 |
| JP | 2002-40961 | | 2/2002 |
| JP | 2002-351357 | | 12/2002 |
| JP | 2003-058108 | | 2/2003 |
| JP | 2003-76327 | | 3/2003 |
| JP | 2003-114645 | | 4/2003 |
| JP | 2003-157048 | | 5/2003 |
| JP | 2003-177722 | | 6/2003 |
| JP | 2003-195812 | | 7/2003 |
| JP | 2003-195815 | | 7/2003 |
| JP | 2003-330386 | | 11/2003 |
| JP | 2004-029528 | | 1/2004 |
| JP | 2004-29755 | | 1/2004 |
| JP | 2004-145224 | | 5/2004 |
| JP | 2005-157273 | | 6/2005 |
| KR | 2003-0075946 | | 9/2003 |
| WO | WO 02/39420 | A1 | 5/2002 |
| WO | WO 03/038796 | A1 | 5/2003 |
| WO | WO 03/038797 | | 5/2003 |
| WO | WO 03/091980 | A1 | 11/2003 |
| WO | WO 2004/077671 | A1 | 9/2004 |

OTHER PUBLICATIONS

Patent Abstracts of Japan, Publication No. 2000-122607, dated Apr. 28, 2000, in the name of Norio Ozawa.
Patent Abstracts of Japan, Publication No. 2000-356978; Publication Date: Dec. 26, 2000; in the name of Yeo et al.
Patent Abstracts of Japan, Publication No. 2003-114645, dated Apr. 18, 2003, in the name of Toshiyuki Kasai.
Patent Abstracts of Japan, Publication No. 2003-195812, dated Jul. 9, 2003, in the name of Katsumi Abe.
Patent Abstract of Japan, Publication No. 2004-029755, dated Jan. 29, 2004, in the name of Hiroshi Takahara.
Korean Patent Abstracts, Publication No. 1020030075946, dated Sep. 26, 2003, in the name of O Gyeong Kwon et al.
Patent abstract of Japan for publication No. 2002-040961, dated Feb. 8, 2002 in the name of Yoshiharu Hashimoto.
Patent abstract of Japan for publication No. 2003-076327; dated Mar. 14, 2003 in the name of Koichi Iguchi.
Patent abstract of Japan for publication No. 2003-195815; dated Jul. 9, 2003 in the name of Akira Yumoto.
Patent abstract of Japan for publication No. 2003-330386; dated Nov. 19, 2003 in the name of Hajime Akimoto, et al.
Patent abstract of Japan for publication No. 2005-157273; dated Jun. 16, 2005 in the name of Dong-Yong Shin.
China Office action dated Jun. 8, 2007, for CN 200510070218.5, and English translation.
U.S. Office action dated Jan. 9, 2008, for related U.S. Appl. No. 10/990,659, indicating relevance of U.S. references listed in this IDS.
U.S. Office action dated Jan. 11, 2008, for related U.S. Appl. No. 10/992,327, indicating relevance of U.S. references listed in this IDS.
U.S. Office action dated Aug. 12, 2008, for related U.S. Appl. No. 11/112,835, indicating relevance of U.S. references listed in this IDS.
U.S. Office action dated Aug. 13, 2008, for related U.S. Appl. No. 10/992,327, indicating relevance of U.S. references listed in this IDS.
Patent Abstracts of Japan, Publication No. 02-306293, dated Dec. 19, 1990, in the name of Toshikazu Shimizu.
Patent Abstracts of Japan, Publication No. 06-118913, dated Apr. 28, 1994, in the name of Hideki Sashita.
Patent Abstracts of Japan, Publication No. 2003-058108, dated Feb. 28, 2003, in the name of Akira Yumoto et al.
Patent Abstracts of Japan, Publication No. 2003-177722, dated Jun. 27, 2003, in the name of Toshio Miyazawa.
Patent Abstracts of Japan, Publication No. 2004-029528, dated Jan. 29, 2004, in the name of Reiji Hatsutori.
Patent Abstracts of Japan, Publication No. 2004-145224, dated May 20, 2004, in the name of Hayato Nakanishi.
T. Kretz et al; "22.3:a 3.4-inch Reflective Colour Active Matrix Liquid Crystal Display without Polarisers"; SID 02 Digest, May 2002, pp. 798-801.
M. Ohta et al; "9.4:A Novel Current Programmed Pixel for Active Matrix OLED Displays"; SID 03 Digest, May 20, 2003, pp. 108-111.
European Search Report, dated Sep. 22, 2005, for Application No. 05103845.3-2205, in the name of Samsung SDI Co., Ltd.
European Search Report dated Apr. 2, 2008, for European application 05103845.3, indicating relevance of U.S. Patent 6,559,836 listed in this IDS.
U.S. Office Action dated Jan. 6, 2009, for related U.S. Appl. No. 10/990,659, indicating relevance of listed U.S. reference in this IDS.
SIPO Patent Gazette, dated Oct. 8, 2008, for Chinese application 200510073819.1, noting references listed in this IDS.
English Abstract of Chinese Patent Gazette for related China Patent 100409282C, listing China references noted in Aug. 6, 2008 in this IDS.
U.S. Office action dated Sep. 30, 2008, for related U.S. Appl. No. 11/124,926, indicating relevance of listed U.S. and Japan references in this IDS.
U.S. Notice of Allowance dated Dec. 2, 2008, for related U.S. Appl. No. 10/997,486, noting listed reference in this IDS.
U.S. Notice of Allowance, dated Apr. 15, 2009, for related U.S. Appl. No. 10/997,486, noting listed reference in this IDS.
U.S. Office action dated Feb. 18, 2009, for related U.S. Appl. No. 11/124,926, noting listed references in this IDS.
Japanese Office action dated Oct. 6, 2009, for corresponding Japanese application 2004-336903, noting listed International publication in this IDS.
U.S. Office action dated Jun. 2, 2009, for related U.S. Appl. No. 11/124,926, noting U.S. Publication 2005/0110727 listed in the IDS.
U.S. Notice of Allowance dated Jul. 9, 2009, for related U.S. Appl. No. 10/992,327, noting U.S. Patents listed in this IDS.
U.S. Office action dated Jul. 13, 2009, for related U.S. Appl. No. 10/990,659, noting U.S. Publication 2003/0030602 listed in this IDS.

* cited by examiner

DISPLAY DEVICE USING DEMULTIPLEXER AND DRIVING METHOD THEREOF

CROSS REFERENCE TO RELATED APPLICATION

This application claims priority to and the benefit of Korean Patent Application No. 10-2003-0085077 filed on Nov. 27, 2003 in the Korean Intellectual Property Office, the entire content of which is incorporated herein by reference.

BACKGROUND OF THE INVENTION (a) Field of the Invention

The present invention relates to a display device using a demultiplexer, and a driving method thereof. More specifically, the present invention relates to a display device for performing demultiplexing by a sample/hold circuit.

(b) Description of the Related Art

A display device generally requires a scan driver for driving scan lines and a data driver for driving data lines. The data driver has as many output terminals as it has data lines to convert digital data signals into analog signals and apply them to all of the data lines. In general, the data driver is configured with a plurality of integrated circuits (ICs). The plurality of ICs are used to drive all of the data lines given that a single IC only contains a certain number of output terminal which is generally insufficient to drive all of the data lines. In order to reduce the number of data driver ICs without affecting the ability to drive all of the data lines, demultiplexers may be employed.

For example, in the case of a 1:2 demultiplexer, the demultiplexer receives data signals that are time-divided and applied by the data driver through a signal line. The demultiplexer divides the data signals into two data groups, and outputs them to two data lines. Therefore, usage of a 1:2 demultiplexer reduces the number of data driver ICs by half. The recent trend with liquid crystal displays (LCDs) and organic electroluminescent displays is to mount the ICs for the data driver on the panel itself. In this instance, there is a greater need to reduce the number of data driver ICs.

Under current technology, when the IC for the demultiplexer, the data driver, and the scan driver is manufactured to be directly mounted on the panel, power supply points, power supply lines, and power wiring are formed as shown in FIG. 1 to supply power to the pixels.

Referring to FIG. 1, a left scan driver 20 is provided on a display area 10 for applying select signals to select scan lines SE1 to SEm, and a right scan driver 30 is provided on the display area 10 for applying signals for controlling light emission to emit scan lines EM1 to EMm. A demultiplexer unit 40 and a data driver 50 are also provided on the display area for applying data signals to data lines D1 to Dm. In this instance, vertical lines 60 are formed for supplying power supply voltages to the respective pixels, and a power line 70 coupled to each vertical line 60 on the top of the substrate is formed in the horizontal direction. The power line 70 and an external power supply line 80 surrounding scan drivers 20, 30 are coupled through a power supply point 90.

In this instance, since the current flows through the power line 70 and the vertical line 60 when a power supply voltage is used in the pixels, a voltage drop (i.e., an IR drop) is generated in the power line 70 and the vertical line 60 because of parasitic resistance provided in the power line 70 and the vertical line 60. The further along the power line 70 and the vertical line 60 from the power supply point 90, the greater the voltage drop that is generated, the generated voltage drop being the greatest near the center of the power line 70 and near the bottom of the vertical line 60.

In general, since the pixels have characteristic deviations of driving transistors, it is generally required to obtain a margin of the saturation area in the characteristic curve of the driving transistors. However, when a great voltage drop is generated, power consumption is increased due to a general need to enlarge the power supply voltage to obtain a sufficient margin of the saturation area. Also, when sample/hold circuits are used for 1:N demultiplexing in the demultiplexer, it is generally required to sample the data current which corresponds to a particular data line during a 1/N time of a single horizontal period, shortening the sampling time and hindering appropriate sampling of the data current.

SUMMARY OF THE INVENTION

According to one embodiment, the present invention provides a display device using a demultiplexer for reducing a voltage drop.

According to another embodiment, the present invention provides a display device for performing appropriate sampling within a given time.

In accordance with an exemplary embodiment of the present invention, a signal line between a demultiplexer and a data driver is precharged with a precharge current before the data are sampled in the demultiplexer.

According to one embodiment of the present invention, a display device includes a display area including a plurality of pixel circuits coupled to a plurality of data lines for transmitting data currents for displaying an image. The display device also includes a plurality of first signal lines and a data driver coupled to the first signal lines for transmitting multiplexed currents corresponding to the data currents to the first signal lines. A demultiplexer unit also included in the display device includes a plurality of demultiplexers demultiplexing the multiplexed currents, each said demultiplexer for transmitting corresponding said data currents to at least two of said data lines. The display device further includes a precharge unit transmitting a precharge currents associated with the multiplexed currents to the first signal lines in response to a control signal before the multiplexed currents are transmitted to the first signal lines.

According to one embodiment, the demultiplexer includes a plurality of sample/hold circuits coupled to a corresponding one of said first signal lines. During a particular horizontal period, sample/hold circuits of one group from among the plurality of sample/hold circuits hold the data currents corresponding to a corresponding said multiplexed current sampled during a previous horizontal period to at the least two said data lines while sample/hold circuits of another group sequentially sample the corresponding said multiplexed current applied through the corresponding said first signal line.

According to one embodiment, first and third sample/hold circuits form the sample/hold circuits of the one group, and second and fourth sample/hold circuits form the sample/hold circuits of the other group. The first and second sample/hold circuits have input terminals coupled to the corresponding one of said first signal lines and output terminals coupled to a first of the at least two said data lines. The third and fourth sample/hold circuits have input terminals coupled to the corresponding one of said first signal lines and output terminals coupled to a second of the at least two said data lines.

According to one embodiment, sample/hold circuit includes a sampling switch being turned on in response to a sampling signal, a holding switch being turned on in response to a holding signal, and a data storage element. Each of the plurality of sample/hold circuit samples the corresponding said multiplexed current when the sampling switch is turned on and holds the data currents corresponding to the corresponding said multiplexed current sampled when the holding switch is turned on. According to one embodiment, the sampling signal is sequentially applied to each of the plurality of sample/hold circuits.

According to one embodiment, data storage element includes a first transistor having a source coupled to a first power and a gate and a drain coupled to the corresponding one of said first signal lines in response to the sampling signal; and a first capacitor, coupled between the gate and the source of the first transistor, for storing a voltage corresponding to the data currents corresponding to the corresponding said multiplexed current transmitted to the gate and the drain.

According to one embodiment, precharge unit includes a second transistor having a source coupled to the first power source, and a gate and a drain coupled to the corresponding one of said first signal lines in response to the control signal.

According to one embodiment, the sampling signal is applied substantially concurrently with interception of the control signal. The precharge current is about M times the corresponding said multiplexed current, where M is a real number greater than 1. A ratio W2/L2 of the second transistor is about M times a ratio W1/L1 of the first transistor, where W1 and W2 are channel widths of respectively the first and second transistors, and L1 and L2 are channel lengths of respectively the first and second transistors.

According to another embodiment, the sampling signal is applied substantially concurrently with the control signal, and the control signal is subsequently intercepted while the sampling signal is applied, the precharge current is about M times the corresponding said multiplexed current, where M is a real number greater than 1. A ratio W2/L2 of the second transistor is about (M−1) times a ratio W1/L1 of the first transistor, where W1 and W2 are channel widths of respectively the first and second transistors, and L1 and L2 are channel lengths of respectively the first and second transistors.

According to one embodiment, the first and second transistors are transistors having a same conductive type.

According to one embodiment, the sampling switch includes a first switch coupled between the gate of the first transistor and the corresponding one of said first signal lines, a second switch for diode-connecting the first transistor in response to the sampling signal, and a third switch coupled between the first power source and the source of the first transistor. The holding switch includes a fourth switch coupled between the drain of the first transistor and a second power source, and a fifth switch coupled between an output terminal of the sample/hold circuit and the first transistor.

According one embodiment, the display area includes a plurality of second signal lines for supplying power supply voltages to the plurality of pixel circuist. The display device further includes a power line, formed between the demultiplex unit and the data driver and crossing the first signal line in a manner insulated from the first signal lines for transmitting the power supply voltages provided from the second signal lines.

According to one embodiment, the first power is coupled to the power line.

According to one embodiment, the precharge unit is formed between the demultiplexer unit and the data driver.

According to one embodiment, each of the plurality of pixel circuits includes a capacitor for storing a voltage corresponding to one of said data currents transmitted through a corresponding one of said data lines, a third transistor having a source and a gate coupled to the second capacitor, the third transistor being the transistor to which current corresponding to the voltage stored in the capacitor flows, and a light emitting element for emitting light corresponding to the current of the third transistor.

According to one embodiment, the light emitting element uses electroluminescent light emission of organic matter.

According to another embodiment, the present invention is directed to a method for driving a display device including a plurality of pixel circuits coupled to a plurality of data lines for transmitting data currents for displaying an image, and a plurality of signal lines each corresponding to at least two of the plurality of data lines and transmitting currents corresponding to the data currents corresponding to the at least two of the plurality of data lines. The method includes applying a first precharge current to the one of the plurality of signal lines and applying to said one of the plurality of signal lines a first current corresponding to the data current to be applied to a corresponding first data line from the at least two data lines. The method further includes applying a second precharge current to said one of the plurality of signal lines and applying to said one of the plurality of signal lines a second current corresponding to the data current to be applied to a corresponding second data line from the at least two data lines. Data currents corresponding to the first and second currents are further applied to the corresponding first and second data lines. The first precharge current is M times the first current and the second precharge current is M times the second current, where M is a real number greater than 1.

According to one embodiment, a first sample/hold circuit is invoked to sample the first current where the first sample/hold circuit is coupled between said one of the plurality of signal lines and the corresponding first data line. A second sample/hold circuit is invoked to sample the second current where the second sample/hold circuit is coupled between said one of the plurality of signal lines and the corresponding second data line.

According to one embodiment, the first precharge current is transmitted to a precharge circuit coupled to said one of the plurality of signal lines when the first precharge current is applied to said one of the plurality of signal lines, and the second precharge current is transmitted to the precharge circuit when the second precharge current is applied to said one of the plurality of signal lines.

According to one embodiment, the first precharge current transmitted to the precharge circuit coupled to said one of the plurality of signal lines is (M−1) times the first current, and the first current is transmitted to the first sample/hold circuit responsive to the first precharge current being applied to said one of the plurality of signal lines. The second precharge current transmitted to the precharge circuit is (M−1) times the second current, and the second current is transmitted to the second sample/hold circuit responsive to the second precharge current being applied to said one of the plurality of signal lines.

In still another embodiment of the present invention, a display device includes a display area including first and second pixel circuits respectively coupled to first and second data lines. The display device also includes a signal line and a first circuit, coupled between the signal line and the first data line for holding a first data current for displaying an image to the first data line. The display device further includes a second circuit, coupled between the signal line and the second data line, for holding a second data current for displaying the image to the second data line. A data driver also included in the display device is coupled to the signal line for sequentially transmitting to the signal line first and second currents respectively corresponding to the first and second data currents. A precharge unit coupled to the signal line for transmitting a first precharge current to the signal line before the first current is applied to the signal line, and transmitting a second precharge current to the signal line before the second current is applied to the signal line. The first and second circuits respectively sample the first and second currents during a single horizontal period, and concurrently hold the first and second data currents respectively corresponding to the first and second currents during a subsequent horizontal period.

According to one embodiment, the first precharge current is M times the first current and the second precharge current is M times the second current, where M is a real number greater than 1.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only exemplary embodiments of the present invention are shown and described, simply by way of illustration. As those skilled in the art would realize, the described exemplary embodiments may be modified in various different ways, all without departing from the spirit or scope of the present invention. Accordingly, the drawings and description are to be regarded as illustrative in nature, and not restrictive.

Figure 1:
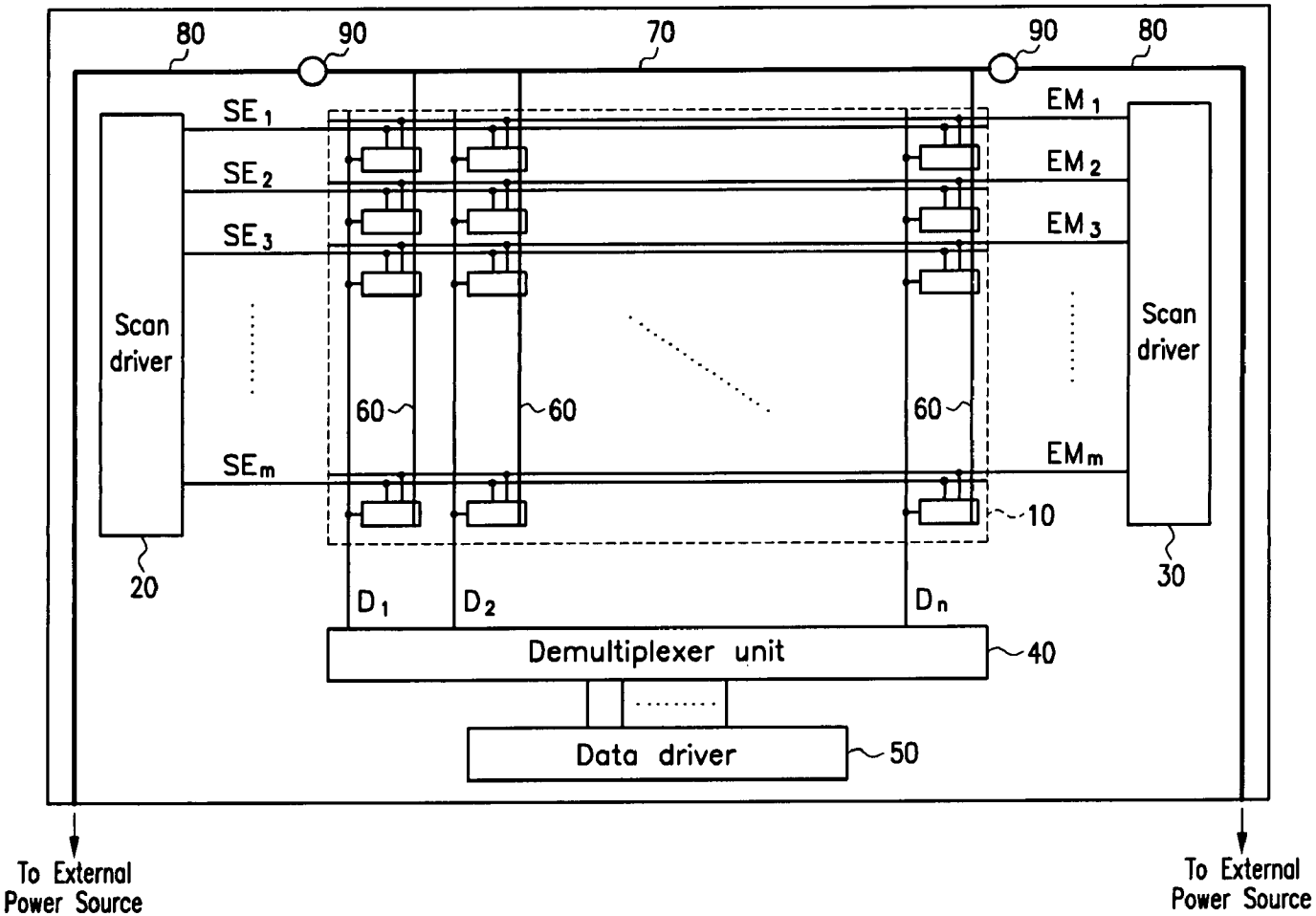
FIG.1 (Prior Art)
FIG. 1 shows a simplified view of a conventional display device using a demultiplexer.
Figure 2:
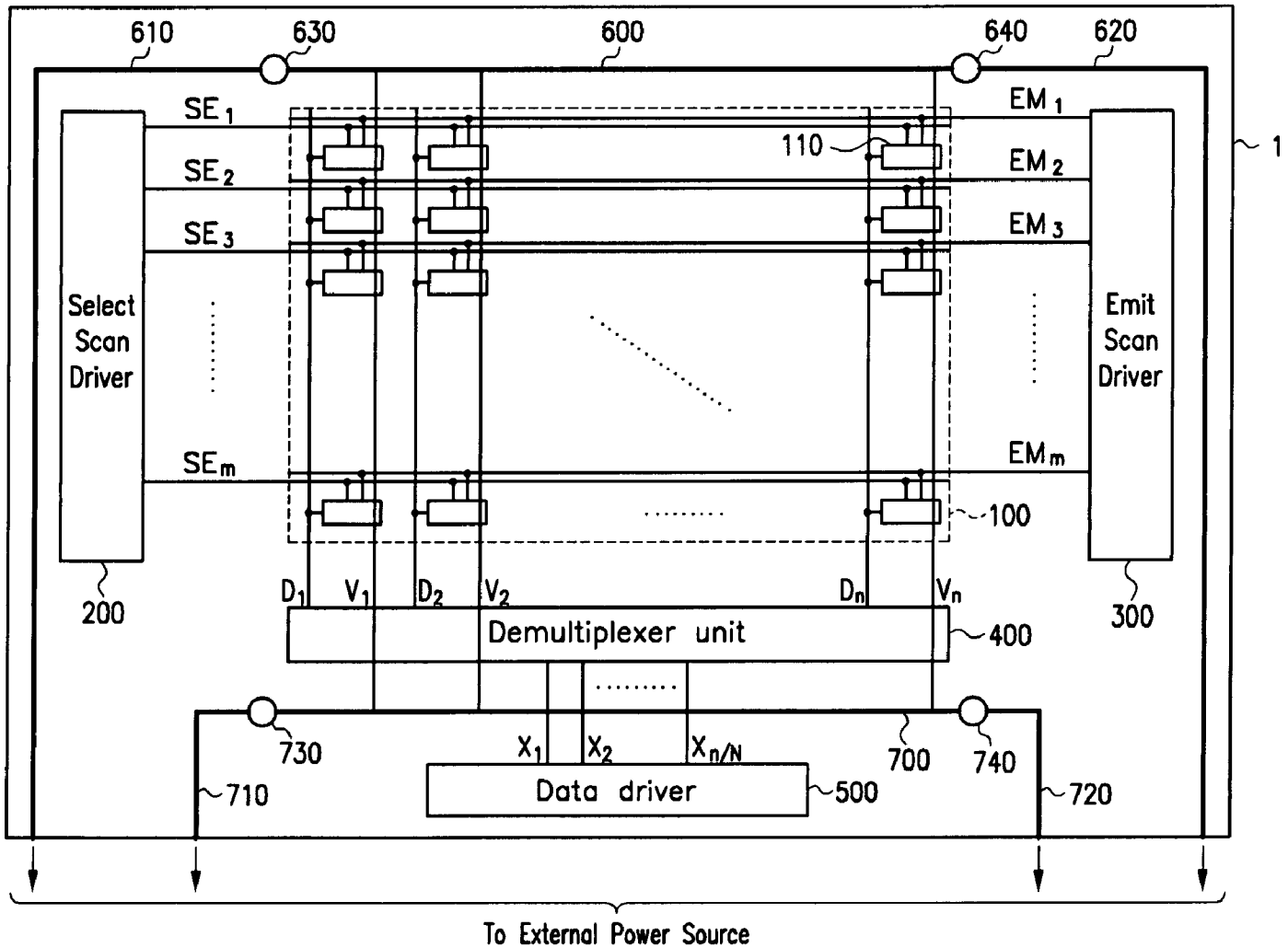
FIG. 2 shows a simplified view of a display device using a demultiplexer according to a first exemplary embodiment of the present invention.
Figure 3:
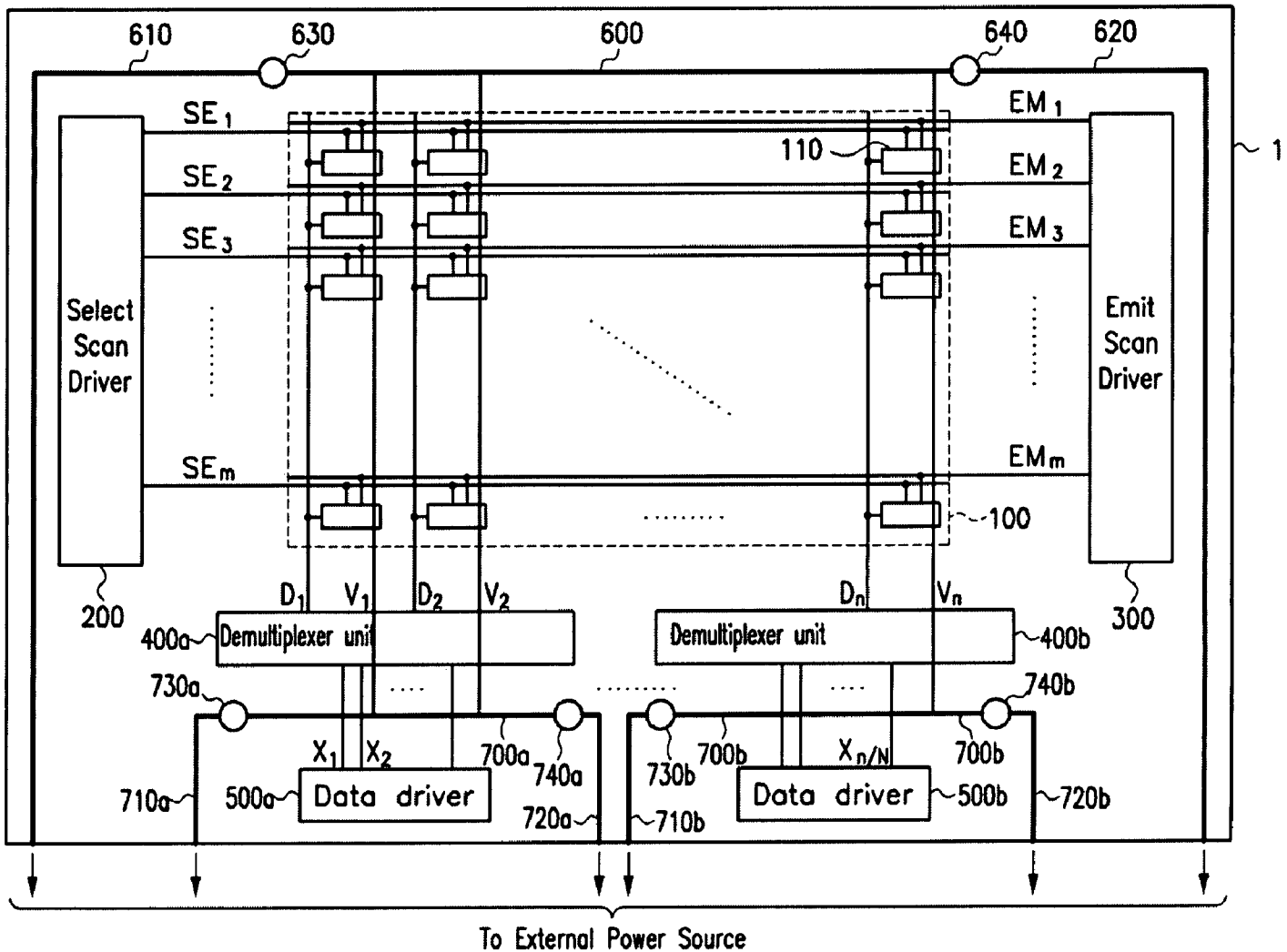
FIG. 3 shows the display device of FIG. 2 including a plurality of data drivers and demultiplexer units.

FIG. 2 shows a simplified view of a display device using a demultiplexer according to a first exemplary embodiment of the present invention. FIG. 3 shows a diagram of the display device of FIG. 2 including a plurality of data drivers and demultiplexers.

As shown in FIG. 2, the display device includes an insulation substrate 1 divided into a display area 100 which is visible to a user of the display device as a screen, and an outer surrounding area. A select scan driver 200, an emit scan driver 300, a demultiplexer unit 400, and a data driver 500 are formed on the surrounding area. According to one embodiment, the data driver 500 may be formed not on the surrounding area of the insulation substrate 1, but rather, at a separate position, and be coupled to the insulation substrate 1, which is different from the embodiment illustrated in FIG. 2.

The display area 100 includes a plurality of data lines D1 to Dn, a plurality of select scan lines SE1 to SEm, a plurality of emit scan lines EM1 to EMm, and a plurality of pixel circuits 110. According to one embodiment, the select and emit scan lines SE1 to SEm and EM1 to EMm are formed on the insulation substrate 1, and gate electrodes (not illustrated) are coupled to the respective scan lines SE1 to SEm and EM1 to EMm which are covered with an insulation film (not illustrated). A semiconductor layer (not illustrated) made of silicon, such as, for example, amorphous silicon or polycrystalline silicon, is formed on the bottom of the gate electrode with an insulation layer therebetween. The data lines D1 to Dn are formed on the insulation film which covers the scan lines SE1 to SEm and EM1 to EMm, and source and drain electrodes are coupled to the respective data lines D1 to Dn. A gate electrode, a source electrode, and a drain electrode configure three terminals of a thin-film transistor (TFT), and a semiconductor layer provided between the source electrode and the drain electrode is a channel layer of the transistor.

Referring to FIG. 2, the data lines D1 to Dn extend in the vertical direction and transmit data currents for displaying images to the pixel circuits 110. The select scan lines SE1 to SEm and the emit scan lines EM1 to EMm extend in the horizontal direction and transmit select signals and emit signals to the pixel circuits 110, respectively. Two adjacent data lines and two adjacent select scan lines define a pixel area where the pixel circuit 110 is formed.

According to one embodiment, the select scan driver 200 sequentially applies the select signals to the select scan lines SE1 to SEm, and the emit scan driver 300 sequentially applies the emit signals to the emit scan lines EM1 to EMm. The data driver 500 time-divides, that is, multiplexes and applies the data signals to the demultiplexer unit 400, and the demultiplexer unit 400 applies the time-divided data signals to the data lines D1 to Dn. When the demultiplexer unit 400 performs 1:N demultiplexing, the number of signal lines X1 to Xn/N for transmitting the data signals to the demultiplexer unit 400 from the data driver 500 is n/N. That is, a signal line X1 transmits the multiplexed and applied data signals to the N data lines D1 to DN.

In this instance, the select and emit scan drivers 200 and 300, the demultiplexer unit 400, and the data driver 500 are mounted in an IC format on the insulation substrate 1, and coupled to the scan lines SE1 to SEm and EM1 to EMm, the signal lines X1 to Xn/N, and the data lines D1 to Dn formed on the insulation substrate 1. In addition, the select and emit scan drivers 200 and 300, the demultiplexer unit 400, and/or the data driver 500 may be formed on the same layer as the layers on which the scan lines SE1 to SEm and EM1 to EMm, the signal lines X1 to Xn/N, the data lines D1 to Dn, and transistors of the pixel circuits are formed on the insulation substrate 1. Further, the data driver 500 may be mounted as a chip on a tape carrier package (TCP), a flexible printed circuit (FPC), or a tape automatic bonding (TAB) coupled to the demultiplexer unit 400.

Referring again to FIG. 2, a plurality of vertical lines V1 to Vn transmit a power supply voltage to the pixel circuits 110 on the display area 100. The vertical lines V1 to Vn may be formed on the same layer as that of the data lines D1 to Dn without being superimposed on the scan lines SE1 to SEm and EM1 to EMm. A power line 600 formed in the horizontal direction on the top of the insulation substrate 1 is coupled to first ends of the vertical lines V1 to Vn. A power line 700 formed in the horizontal direction passes between the demultiplexer unit 400 and the data driver 500. The vertical lines V1 to Vn extend to pass through the demultiplexer unit 400, and couple second ends of the vertical lines V1 to Vn to the power line 700. In this instance, the power line 700 is formed on a layer different from that of the signal lines X1 to Xn/N so that the power line 700 may not be superimposed on the signal lines X1 to Xn/N.

Power supply lines 610 and 620 are formed on the insulation substrate 1 and coupled to the power line 600 of the display area 100 through first power supply points 630 and 640. In a similar manner, power supply lines 710 and 720 are formed on the insulation substrate 1 and coupled to the power line 700 of the display area 100 through power supply points 730 and 740. The power supply lines 610 and 620 extend from the power supply points 630 and 640 and overhang the scan drivers 200 and 300 in the horizontal direction, and further extend in the vertical direction so that the power supply lines 610 and 620 may not be superimposed on the scan lines SE1 to SEm and EM1 to EMm, on the data lines D1 to Dn, or on the signal lines X1 to Xn/N. In a like manner, the power supply lines 710 and 720 extend in the vertical direction from the power supply points 730 and 740 so that the power supply lines 710 and 720 may not be superimposed on the scan lines SE1 to SEm and EM1 to EMm, on the data lines D1 to Dn, or on the signal lines X1 to Xn/N.

In this instance, first ends of the power supply lines 610, 620, 710, and 720 extended in the vertical direction are coupled to a pad (not illustrated), and further coupled to an external circuit board through the pad.

According to one embodiment, the power lines 600 and 700 and power supply lines 610, 620, 710, and 720 are formed to be thicker than vertical lines V1 to Vn since these power lines transmit the current or the voltage to the vertical lines V1 to Vn.

Accordingly, four power supply points 630, 640, 730, 740 are formed on the insulation substrate 1 to help solve the voltage drop generated at the bottom of the vertical lines V1 to Vn.

When a plurality of demultiplexer units 400*a*, 400*b* and data drivers 500*a*, 500*b* are formed as shown in FIG. 3, power supply lines 710*a*, 710*b*, 720*a*, 720*b* are additionally arranged between the two data drivers 500*a*, 500*b* to increase the number of power supply points 630, 640, 730*a*, 730*b*, 740*a*, 740*b*.

Referring to FIGS. 4 to 8, a display device with a demultiplexer unit including sample/hold circuits will be described. For ease of description, the demultiplexer unit is described to perform 1:2 demultiplexing employing the first signal line X1 and the data lines D1 and D2 corresponding to the signal line X1.

Figure 4:
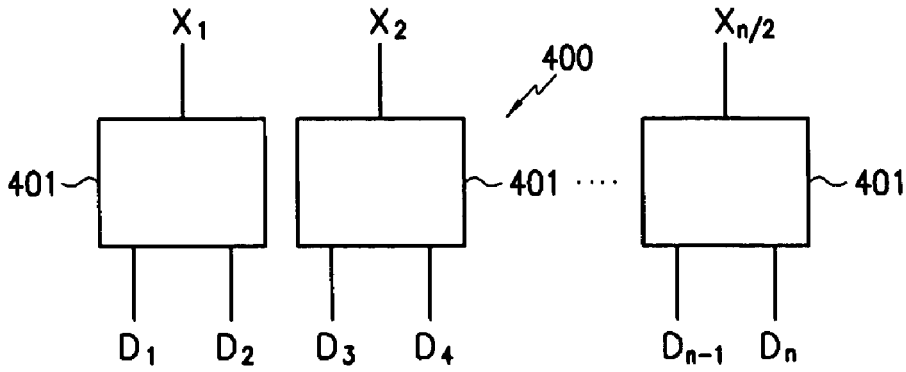
FIG. 4 shows a demultiplexer unit according to an exemplary embodiment of the present invention.
Figure 5:
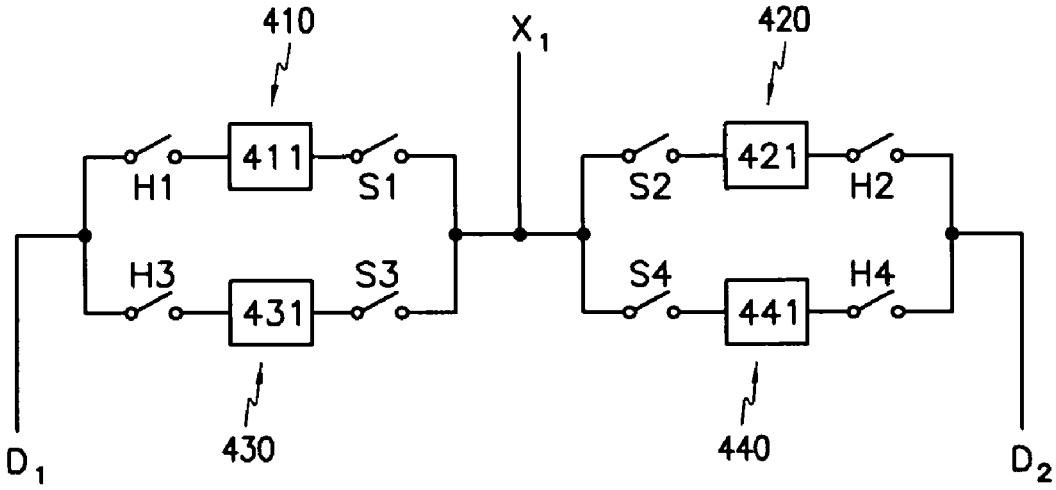
FIG. 5 shows a demultiplexer including sample/hold circuits.

As shown in FIG. 4, the demultiplexer unit 400 includes a plurality of demultiplexers 401. Referring to FIGS. 4 and 5, the demultiplexer 401 includes four sample/hold circuits 410, 420, 430, and 440. The sample/hold circuits 410, 420, 430, and 440 include sampling switches S1, S2, S3, and S4, data storage units 411, 421, 431, and 441, and holding switches H1, H2, H3, and H4. First terminals of the sampling switches S1, S2, S3, and S4 of the sample/hold circuits 410, 420, 430, and 440 are respectively coupled to the data storage units 411, 421, 431, and 441, and first terminals of the holding switches H1, H2, H3, and H4 are respectively coupled to the data storage units 411, 421, 431, and 441. Second terminals of the sampling switches S1, S2, S3, and S4 of the sample/hold circuits 410, 420, 430, and 440 are coupled in common to the signal line X1. Second terminals of the holding switches H1 and H3 of the sample/hold circuits 410 and 430 are coupled in common to the data line D1, and second terminals of the holding switches H2 and H4 of the sample/hold circuits 420 and 440 are coupled in common to the data line D2. The second terminals of the sampling switches S1, S2, S3, and S4 coupled to the signal line X1 will hereinafter be referred to as input terminals, and the second terminals of the holding switches H1, H2, H3, and H4 coupled to the data lines D1 and D2 will hereinafter be referred to as output terminals.

When the sampling switches S1, S2, S3, and S4 are turned on, sample/hold circuits 410, 420, 430, and 440 respectively sample the currents transmitted through the sampling switches S1, S2, S3, and S4 and store them in the data storage units 411, 421, 431, and 441 in a voltage format. When the holding switches H1, H2, H3, and H4 are turned on, the sample/hold circuits 410, 420, 430, and 440 respectively hold the currents corresponding to the voltages stored in the data storage units 411, 421, 431, and 441 through the holding switches H1, H2, H3, and H4.

Referring to FIG. 5, the sample/hold circuits 410 and 430 coupled between the signal line X1 and the data line D1 form a single sample/hold circuit unit, and the two sample/hold circuits 410 and 430 alternately perform sampling and holding. In a like manner, the sample/hold circuits 420 and 440 coupled between the signal line X1 and the data line D2 form a single sample/hold circuit unit, and the two sample/hold circuits 420 and 440 alternately perform sampling and holding.

According to one embodiment of the invention, a sampling function of the sample/hold circuit includes recording an input current in a data storage element in voltage format, a standby function includes maintaining the data recorded in the data storage element, and a holding function includes outputting a current corresponding to the data recorded in the data storage element.

Referring to FIGS. 6 and 7A to 7D, an operation of the demultiplexer shown in FIG. 5 will be described.

Figure 6:
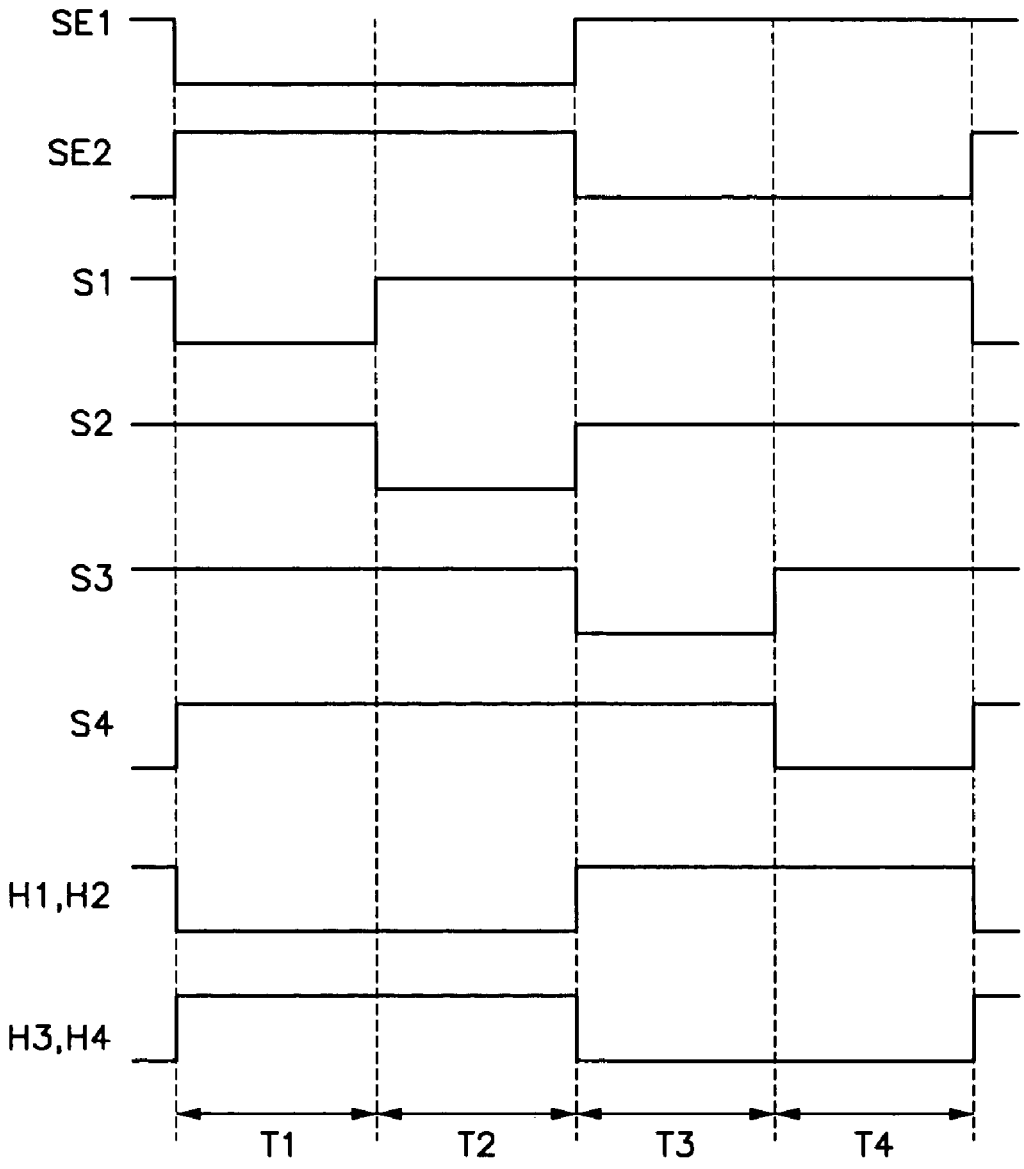
FIG. 6 shows a driving timing diagram of switches in the demultiplexer of FIG. 5.

FIG. 6 shows a driving timing diagram of switches in the demultiplexer of FIG. 5, and FIGS. 7A to 7D show an operation of the demultiplexer of FIG. 5 according to the timing diagram of FIG. 6. According to this timing diagram, sampling switches S1, S2, S3, and S4 are turned on when an associated control signal level is low, and the holding switches H1, H2, H3, and H4 are turned on when an associated control signal level is high.

Figure 7A:
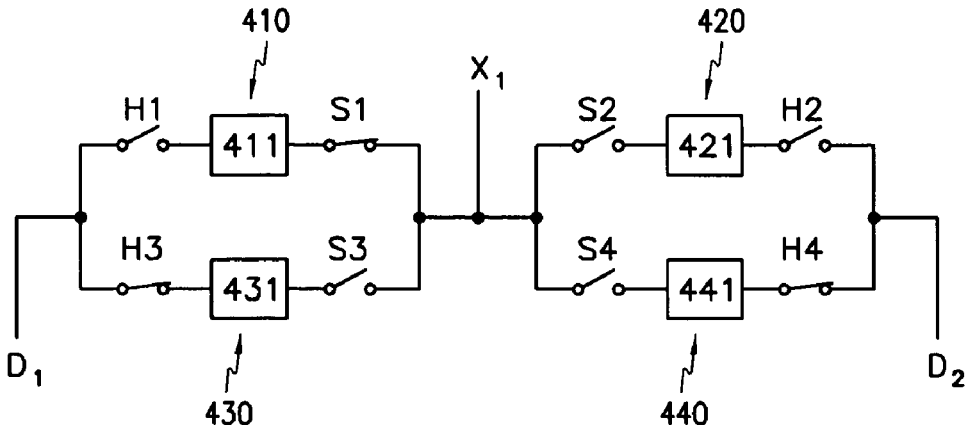
FIGS. 7A to 7D show an operation of the demultiplexer of FIG. 5 according to the timing diagram of FIG. 6.

Referring to FIGS. 6 and 7A, the sampling switch S1 and the holding switches H3 and H4 are turned on in response to a control signal at time period T1. When the sampling switch S1 is turned on, the sample/hold circuit 410 samples the data current applied through the signal line X1 into the storage element 411. When the holding switches H3 and H4 are turned on, the sample/hold circuits 430 and 440 hold the currents corresponding to the data stored in the storage elements 431 and 441 to the data lines D1 and D2. The sample/ hold circuit 420 with the turned-off sampling switch S2 and the holding switch H2 stand by.

Figure 7B:
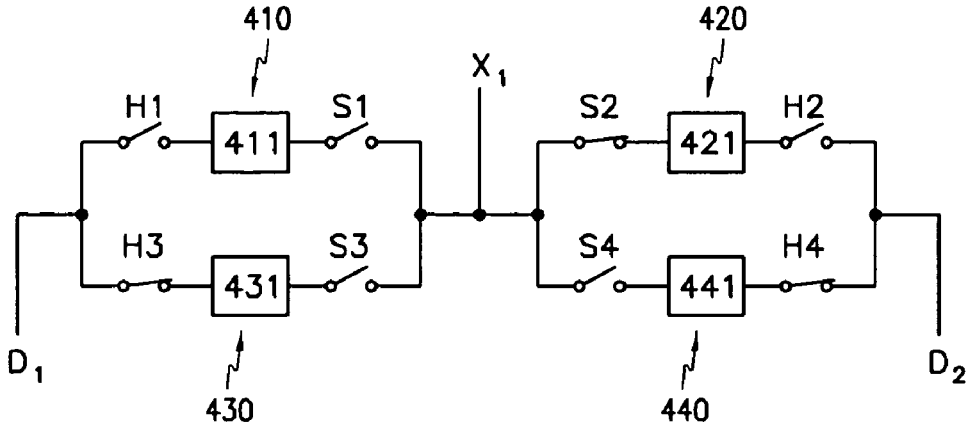

Referring to FIGS. 6 and 7B, the sampling switch S1 is turned off and the sampling switch S2 is turned on in response to a control signal while the holding switches H3 and H4 are turned on at time period T2. Since the holding switches H3 and H4 are turned on, the currents corresponding to the data stored in the storage elements 431 and 441 are consecutively held to the data lines D1 and D2. When the sampling switch S2 is turned on, the sample/hold circuit 420 samples the data current applied through the signal line X1 into the storage element 421.

Figure 7C:
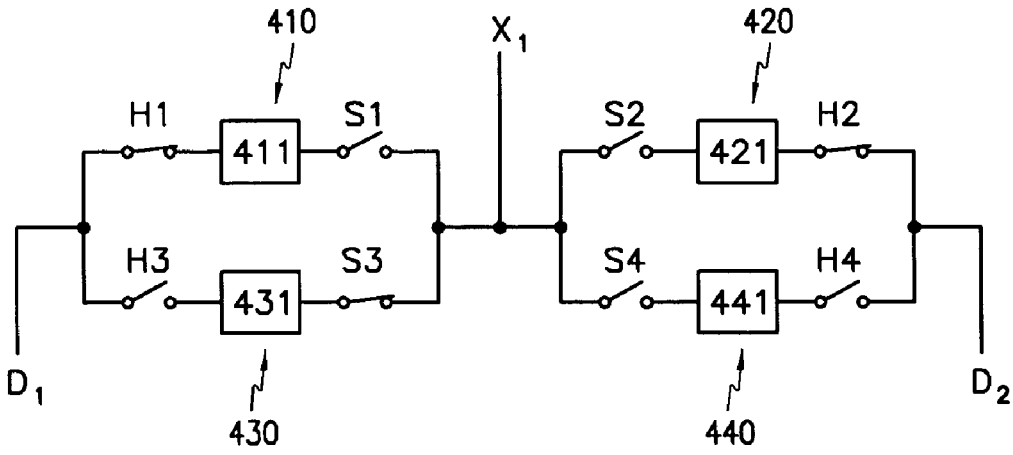

Referring to FIGS. 6 and 7C, the sampling switch S2 and the holding switches H3 and H4 are turned off and the sampling switch S3 and the holding switches H1 and H2 are turned on in response to a control signal at time period T3. When the sampling switch S3 is turned on, the sample/hold circuit 430 samples the data current applied through the signal line X1 into the storage element 431. When the holding switches H1 and H2 are turned on, the sample/hold circuits 410 and 420 respectively hold the currents corresponding to the data stored in the storage elements 411 and 421 to the data lines D1 and D2.

Figure 7D:
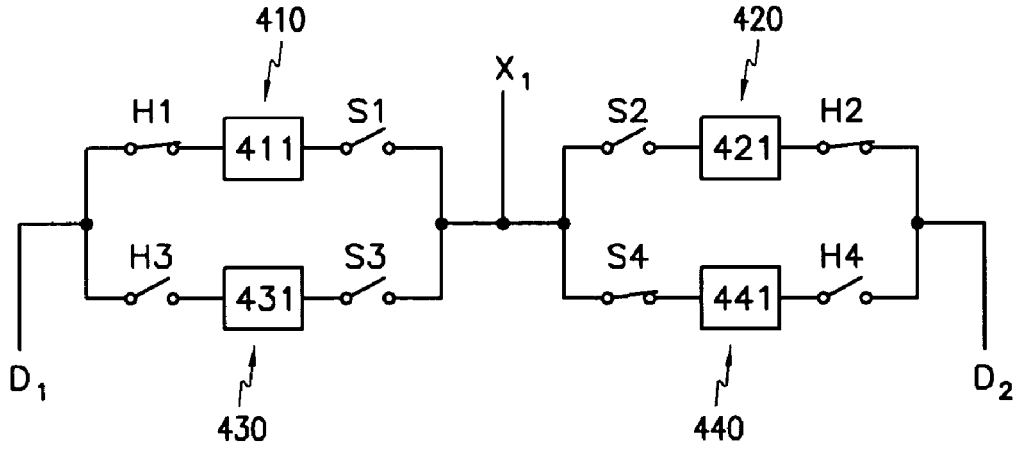

Referring to FIGS. 6 and 7D, the sampling switch S3 is turned off and the sampling switch S4 is turned on in response to a control signal while the holding switches H1 and H2 are turned on at time period T4. Since the holding switches H1 and H2 are turned on, the currents corresponding to the data stored in the storage elements 411 and 421 consecutively hold to the data lines D1 and D2. When the sampling switch S4 is turned on, the sample/hold circuit 440 samples the data current applied through the signal line X1 into the storage element 441.

As described, the sample/hold circuits 410, 420, 430, and 440 of the demultiplexer 401 are classified into two groups according to the sampling and holding operations. The sample/hold circuits 430 and 440 of a second group hold the previously sampled data to the data lines D1, D2 while the sample/hold circuits 410 and 420 of a first group perform sampling of data current applied through the signal line X1. In a like manner, the sample/hold circuits 410 and 420 of the first group hold the previously sampled data while the sample/hold circuits 430 and 440 of the second group perform sampling. Since, according to one embodiment of the invention, the holding switches H1 and H2 are operated at substantially the same time, they may be driven with the same control signal, and the two holding switches H3 and H4 may be driven with a same control signal in a like manner.

In this instance, time periods T1 and T2 correspond to a period during which data is applied to a pixel circuit coupled to a one-row of a scan line according to a select signal (hereinafter referred to as a "horizontal period"), and time periods T3 and T4 correspond to a next horizontal period. Sufficient time for programming data to the pixels may therefore be obtained since the data current may be consecutively applied to a particular data line during a single horizontal period, and the data current may be transmitted to the particular data line during a particular frame since time periods T1 to T4 are repeated.

Since the four sample/hold circuits included in the demultiplexer of FIG. 5 may be substantially identically realized, one of the sample/hold circuits, namely, sample/hold circuit 410 of FIG. 5, will be described in more detail with reference to FIG. 8.

Figure 8:
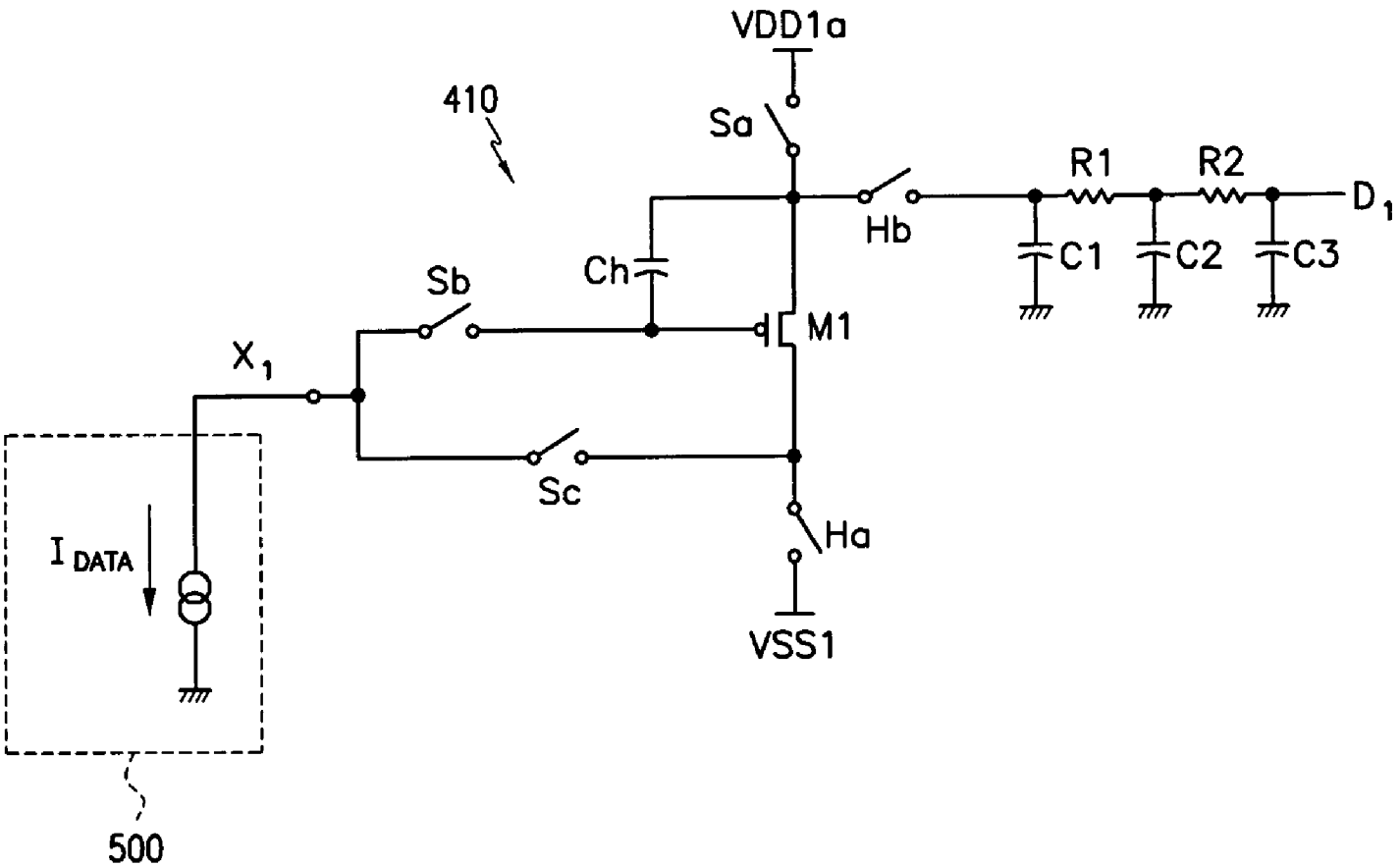
FIG. 8 shows a simplified circuit diagram of the sample/hold circuit of FIG. 5.

FIG. 8 shows a brief circuit diagram of the sample/hold circuit 410 of FIG. 5.

The sample/hold circuit 410 of FIG. 8 is coupled between the signal line X1 and the data line D1, and includes a transistor M1, a capacitor Ch, and five switches Sa, Sb, Sc, Ha, and Hb. Parasitic resistance components and parasitic capacitance components are formed in the data line D1, where parasitic resistance components are exemplified as R1 and R2, and parasitic capacitance components are exemplified as C1, C2, and C3. The transistor M1 is, according to one embodiment, a p-channel field-effect transistor, in particular, a metal oxide semiconductor field-effect transistor (MOSFET).

The switch Sa is coupled between a power supply voltage VDD1*a* and a source of the transistor M1. The switch Ha is coupled between a power supply voltage VSS1 and a drain of the transistor M1. Since, according to the illustrated embodiment, transistor M1 is a p-channel type, the power supply voltage VDD1*a* has a voltage greater than the power supply voltage VSS1, and it is supplied by the vertical lines V1 to Vn coupled to the power line 700. The switch Sb is coupled between the signal line X1 which is an input terminal and the gate of the transistor M1, and the switch Hb is coupled between the source of the transistor M1 and the data line D1 which is an output terminal. The switch Sc is coupled between the signal line X1 and the drain of the transistor, and diode-connects the transistor M1 when the switches Sb and Sc are turned on. In this instance, the switch Sc can be coupled between the gate and the drain of the transistor M1 to diode-connect the transistor M1. When the switch Sc is coupled between the gate and the drain of the transistor M1, the switch Sb can be coupled between the signal line X1 and the drain of the transistor M1.

An operation of the sample/hold circuit 410 of FIG. 8 will be described. According to one embodiment, the switches Sa, Sb, and Sc are turned on/off at substantially the same time, and the switches Ha and Hb are turned on/off at substantially the same time.

When the switches Sa, Sb, and Sc are turned on and the switches Ha and Hb are turned off, the transistor M1 is diode-connected, the current is supplied to the capacitor Ch which is then charged with a voltage, the gate potential of the transistor M1 is lowered, and the current accordingly flows to the drain from the source. Upon passage of a certain period of time, the charged voltage of the capacitor Ch is increased, and the drain current of the transistor M1 corresponds to the data current $I_{DATA}$ provided from the signal line X1, the charged current of the capacitor Ch is no longer increased, and hence, the capacitor Ch is charged with a constant voltage. In this instance, the relation between an absolute value $V_{SG}$ of a voltage between the source and the gate of the transistor M1 (hereinafter referred to as a "source-gate voltage") and the data current $I_{DATA}$ provided from the signal line X1 satisfies Equation 1. In this manner, sample/hold circuit 410 samples the data current provided from the signal line X1.

$$I_{DATA} = \frac{\beta}{2}(V_{SG} - V_{TH})^2 \qquad \text{Equation 1}$$

where β is a constant determined by a channel width and a channel length of the transistor M1, and $V_{TH}$ is an absolute threshold voltage of the transistor M1.

When the switches Sa, Sb, and Sc are turned off and the switches Ha and Hb are turned on, the current corresponding to the source-gate voltage $V_{SG}$ charged in the capacitor Ch, that is, the data current $I_{DATA}$ is transmitted to the data line D1 through the switch Hb. In this manner, the sample/hold circuit 410 holds the current to the data line D1.

The sample/hold circuit 410 maintains the voltage charged in the capacitor Ch since the switches Sa, Sb, Sc, Ha, and Hb are turned off while the sample/hold circuit 420 of FIG. 5 performs sampling at time period T2. That is, the sample/hold circuit 410 enters a standby state.

The switches Sa, Sb, and Sc correspond to the sampling switch S1 of FIG. 5 since the sample/hold circuit 410 performs sampling when the switches Sa, Sb, and Sc are turned on, and the switches Ha and Hb correspond to the holding switch H1 of FIG. 5 since the sample/hold circuit 410 performs holding when the switches Ha and Hb are turned on. The capacitor Ch and the transistor M1 correspond to the data storage element 411 since they function to store a voltage corresponding to the data current. The switches Sa, Sb, Sc, Ha, and Hb may be realized with p-channel or n-channel FETS. The switches Sa, Sb, and Sc may be realized with first transistors having a same conductivity type, and the switches Ha and Hb realized with second transistors having a same conductivity type. For example, switches Sa, Sb, and Sc may be realized with the p-channel transistors and the switches Ha and Hb realized with the n-channel transistors so that they may be driven according to the timing diagram of FIG. 6.

The sample/hold circuit 410 of FIG. 8 sources the data current to the signal line X1, that is, the input terminal during the sampling operation, and sinks the data current from the data line D1, that is, the output terminal during the holding operation. Accordingly, the sample/hold circuit 410 shown in FIG. 8 may be used together with the data driver 500 for sinking the data current at signal line X1, that is, a data driver having a current sink type output terminal. Since a driving IC having a current sink type output terminal is generally cheaper than a driving IC having a current source type output terminal, the cost of the data driver 500 is reduced.

Also, when the transistor M1 is realized with an n-channel FET and the relative voltage levels of the power supply voltages VDD1*a* and VSS1 are exchanged with each other in FIG. 8, a sample/hold circuit having a current sink type input terminal and a current source type output terminal may be realized. No detailed description on the configuration of the sample/hold circuit will be provided since it will be apparent to a person skilled in the art.

As described, the demultiplexer of FIG. 5 sequentially samples the data current that has been time-divided and applied through the signal line X1 during one horizontal period, and concurrently applies the sampled current to the data lines D1 and D2 during the next horizontal period. While performing a 1:N demultiplexing operation, the time for the demultiplexer to sample the data current corresponding to a single data line D1 is about 1/N of one horizontal period. Therefore, demultiplexer 400 must generally sample the data current corresponding to the single data line during the time corresponding to 1/N of one horizontal period. In order to do this, the capacitance component at the signal line X1 when the data driver 500 applies the data current through the signal line X1 should be less than 1/N of the capacitance component at the data line D1 when the demultiplexer 400 applies the sampled current through one data line D1, as described in detail with reference to FIGS. 9 to 12.

Figure 9:
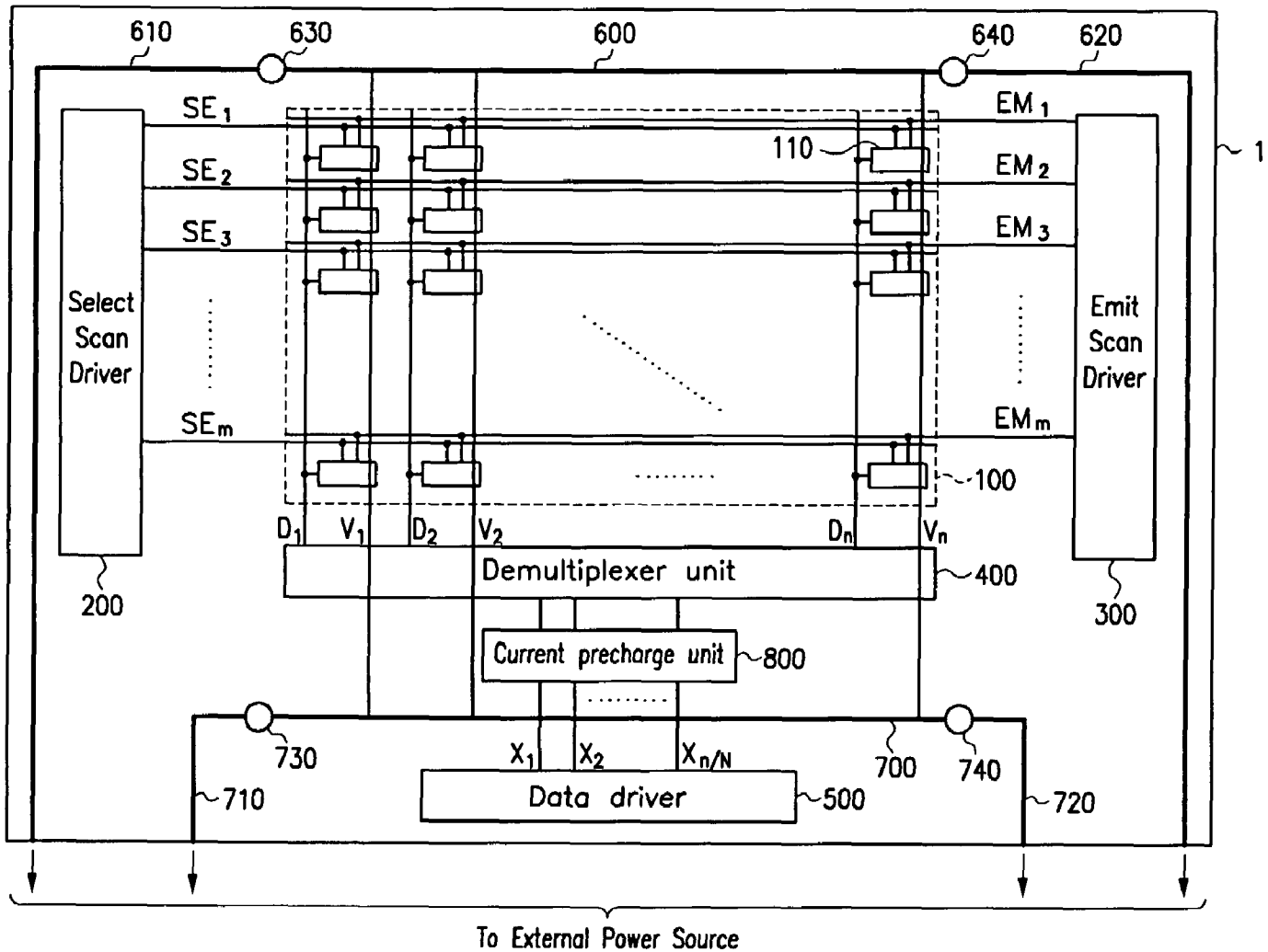
FIG. 9 shows a simplified view of a display device using a demultiplexer according to a second exemplary embodiment of the present invention.

FIG. 9 shows a simplified view of a display device using a demultiplexer according to a second exemplary embodiment of the present invention.

As shown, the display device includes a current precharge unit 800 provided between the demultiplexer 400 and the data driver 500. The current precharge unit 800 transmits a precharge current $MI_{DATA}$ which is M (where M is a real number greater than 1) times the data current $I_{DATA}$, to the signal lines X1 to Xn/N before the data driver 500 transmits the data current to the demultiplexer 400. The power line 700 passes between the current precharge unit 800 and the data driver 500. Also, the data driver 500 generates an additional current for generating the precharge current together with the data current. The additional current is (M−1) times the data current $I_{DATA}$, represented as $(M-1)I_{DATA}$, and is generated from the data current $I_{DATA}$ by using a current mirror circuit according to conventional mechanisms which are well known to those of skill in the art.

Figure 10:
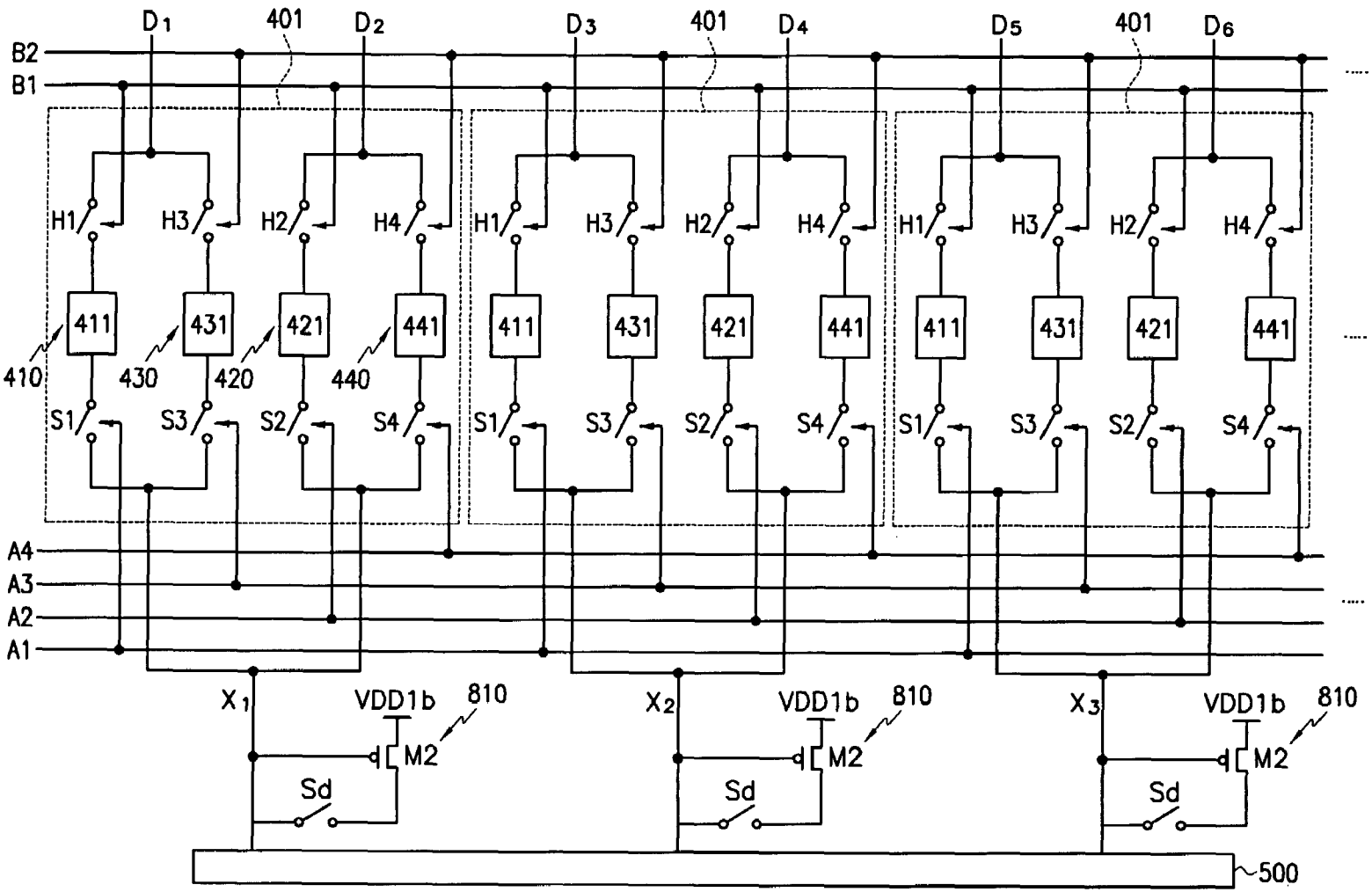
FIG. 10 shows a diagram of a data driver, a current precharge unit, and a demultiplexer unit of FIG. 9.

FIG. 10 is a more detailed diagram of the demultiplexer unit 400 and current precharge unit 800 of FIG. 9. In the embodiment illustrated in FIG. 10, each demultiplexer 401 included in the demultiplexer unit 400 is a 1:2 demultiplexer. However, a person of skill in the art should recognize that FIG. 10 may be expanded to cover a 1:N demultiplexer. In the embodiment illustrated in FIG. 10, the current precharge unit 800 includes a plurality of precharge circuits 810 each of which is coupled to a demultiplexer 401. The precharge circuits 810 are coupled to the data driver 500 via respective signal lines X1 to Xn/2. Since one sample/hold circuit corresponding to the data current from among the sample/hold circuits 410, 420, 430, and 440 of the demultiplexer 401 samples the applied data current according to the data current that has been time-divided and applied by the data driver 500, the precharge circuit 810 coupled to the signal line X1 and the sample/hold circuit 410 coupled between the signal line X1 and the data line D1 will be described in detail with reference to FIG. 11.

Figure 11:
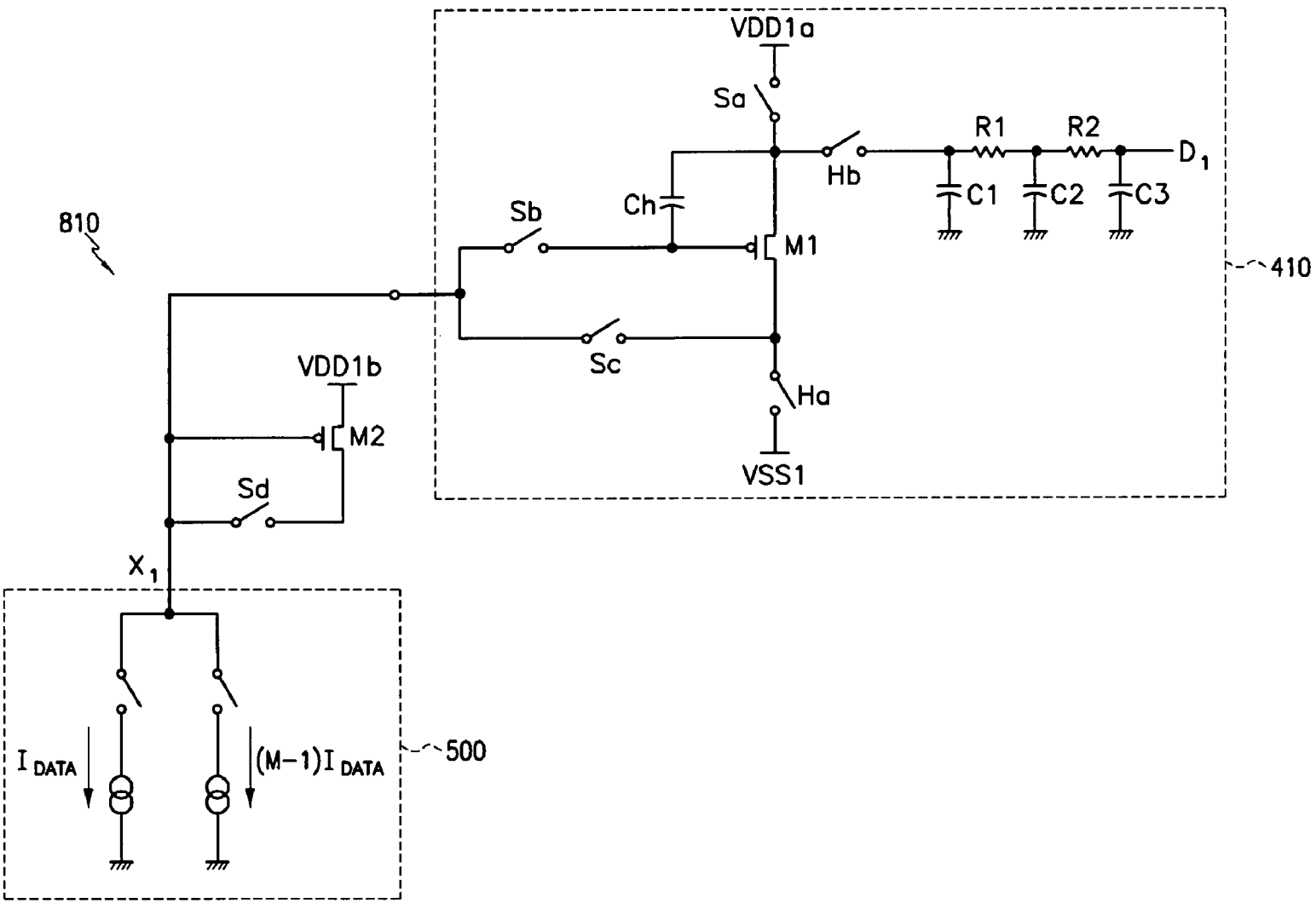
FIG. 11 shows a sample/hold circuit and a demultiplexer.

As illustrated in FIGS. 10 and 11, the precharge circuit 810 includes a transistor M2 and a switch Sd. According to one embodiment, the transistor M2 has the same channel type as that of the transistor M1 of the sample/hold circuit 410. The transistor M2 of FIG. 11 is illustrated to be a p-channel FET like transistor M1. A ratio W2/L2 of a channel width W2 to a channel length L2 of the transistor M2 is M times a ratio W1/L1 of a channel width W1 to a channel length L1 of the transistor M1. The source of the transistor M2 is coupled to the power supply voltage VDD1*b*, and the gate of the transistor M2 is coupled to the signal line X1. According to one embodiment, the power supply voltage VDD1*b* is equal to power supply voltage VDD1*a* supplied to the sample/hold circuit 810. Power supply voltage VDD1*a* and VDD1*b* may be provided by the same power source. A parasitic capacitance component is formed between the source and the gate of the transistor M2. A capacitor (not shown) may additionally be coupled to the source and the gate of the transistor M2. A switch Sd is coupled between the drain of the transistor M2 and the signal line X1 or between the drain and the gate of the transistor M2. The transistor M2 is diode-connected when the switch Sd is turned on.

Figure 12A:
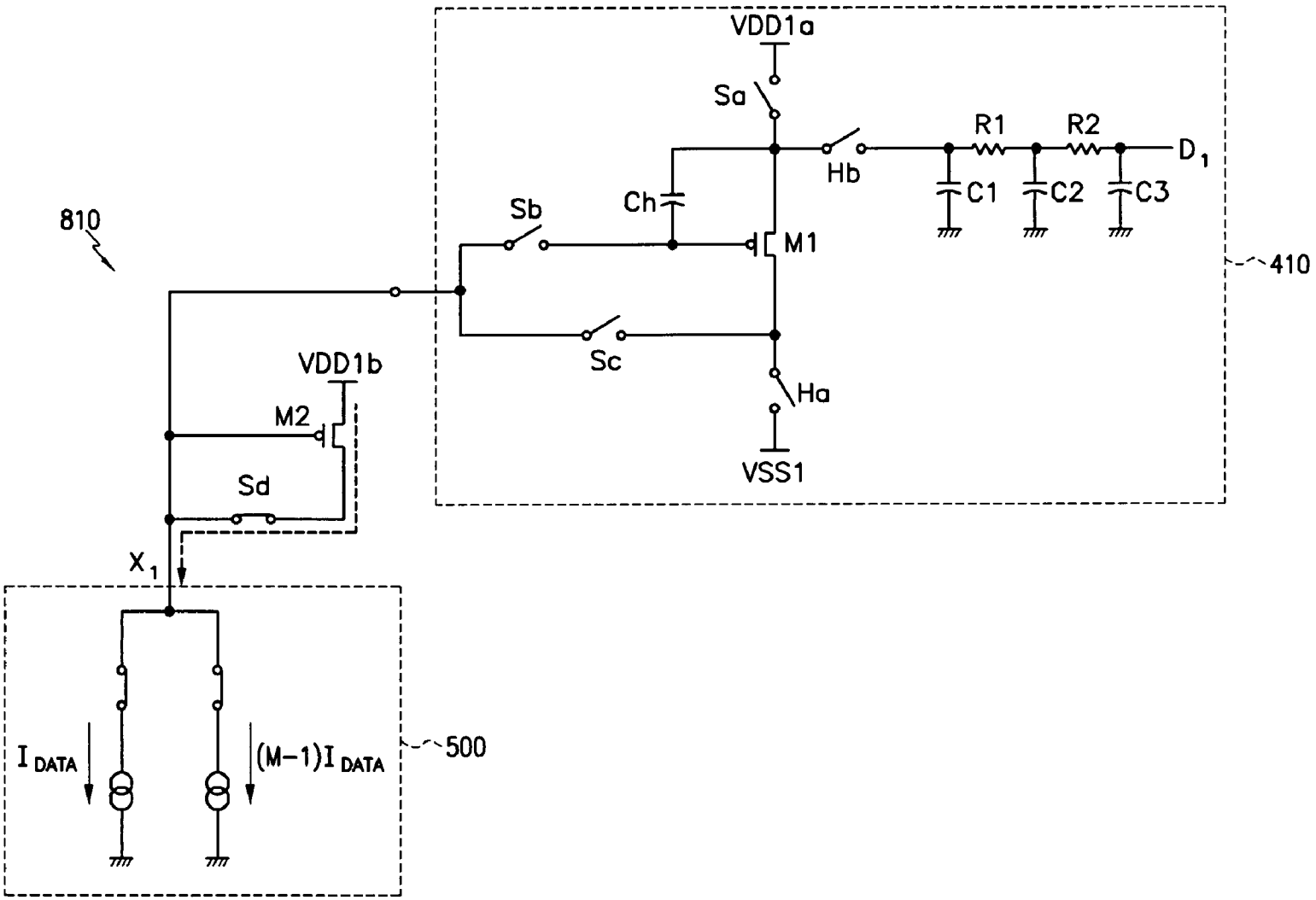
FIGS. 12A and 12B show an operation of a precharge circuit and sample/hold circuit according to a second exemplary embodiment of the present invention.
Figure 12B:
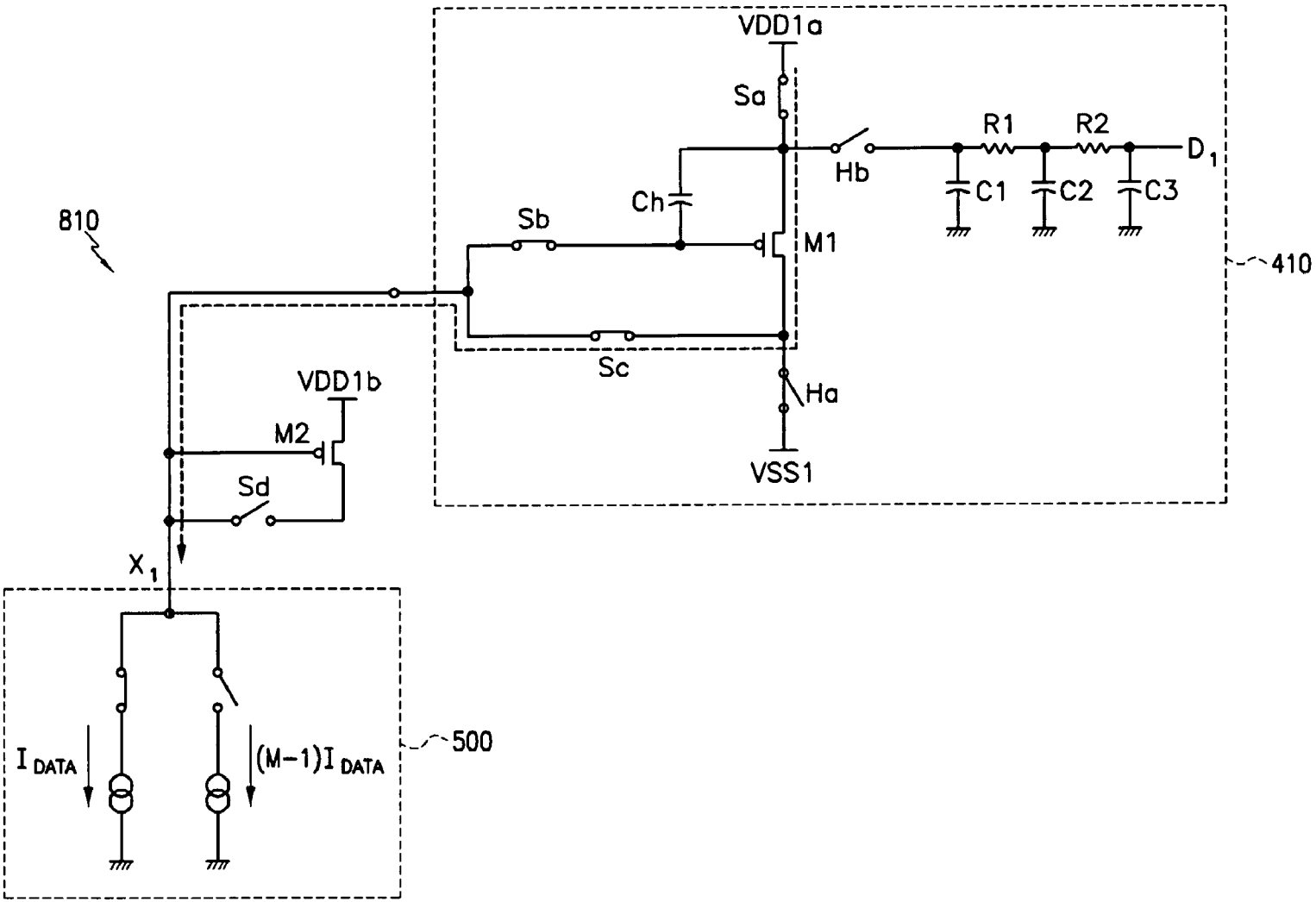
Figure 13:
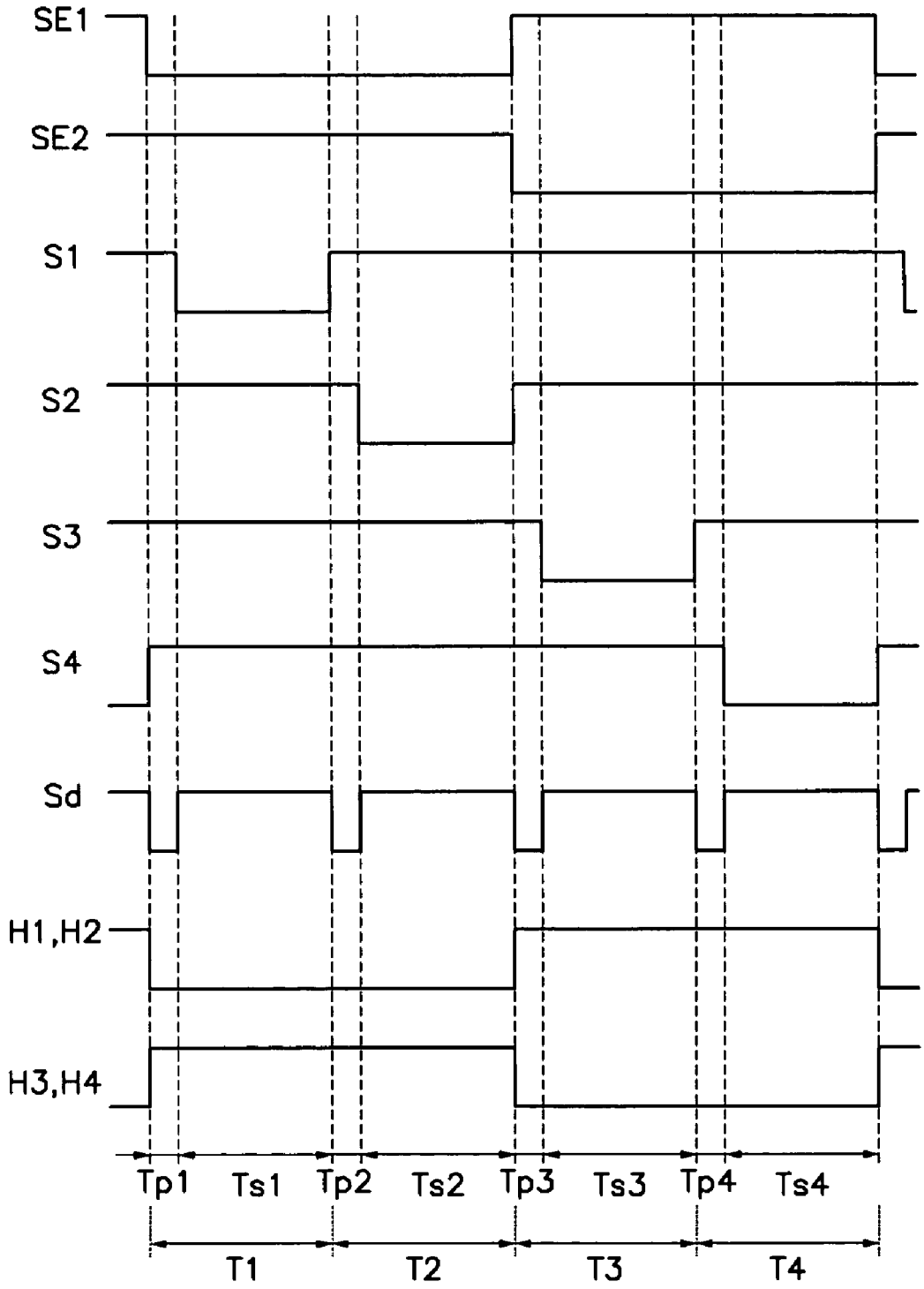
FIG. 13 shows a driving timing diagram for operating a precharge circuit and sample/hold circuit according to a second exemplary embodiment of the present invention.

FIGS. 12A and 12B show an operation of the precharge circuit 810 according to a second exemplary embodiment of the present invention. FIG. 13 shows a driving timing diagram for operating the precharge circuit 810 according to the second exemplary embodiment of the present invention. Referring to FIG. 13, the switch Sd and the sampling switches S1, S2, S3, and S4, that is, the switches Sa, Sb, and Sc are turned on when a respective control signal level is low, and the holding switches H1, H2, H3, and H4, that is, the switches Ha and Hb are turned on when a respective control signal level is high.

Referring to FIGS. 12A and 13, a precharge operation is performed so as to reduce a sampling time during the precharge period Tp1 before the sample/hold circuit 410 samples the data current. In detail, the data driver 500 applies the data current $I_{DATA}$ and the additional current $(M-1)I_{DATA}$ to the signal line X1. Concurrently with this, the switch Sd is turned on and the transistor M2 is diode-connected. This causes precharge current $MI_{DATA}$ corresponding to M times the data current $I_{DATA}$ to be transmitted to the drain of the transistor M2 through the signal line X1. Because the ratio W2/L2 of the channel width to the channel length of the transistor M2 is M times the ratio W1/L1 of the channel width to the channel length of the transistor M1, a constant of the transistor M2 which is determined by the channel width and length of transistor M2 is M times a constant $\beta$ of the transistor M1 which is determined by the channel width and length of transistor M1. Since the source-gate voltage $V_{SG2}$ at the transistor M2 is given in Equation 2 from this, Equation 3 may be obtained from Equation 1 which is satisfied when the data current $I_{DATA}$ is supplied to the sample/hold circuit 410.

$$MI_{DATA} = \frac{M\beta}{2}(V_{SG2} - V_{TH2})^2 \quad \text{Equation 2}$$

where $V_{TH2}$ is a threshold voltage of the transistor M2.

$$\frac{\beta}{2}(V_{SG2} - V_{TH2})^2 = I_{DATA} = \frac{\beta}{2}(V_{SG} - V_{TH})^2 \quad \text{Equation 3}$$

Referring to Equation 3, when the threshold voltage $V_{TH}$ of transistor M1 corresponds to the threshold voltage $V_{TH2}$ of the transistor M2, the source-gate voltage $V_{SG2}$ at the transistor M2 caused by the precharge current $MI_{DATA}$ corresponds to the source-gate voltage $V_{SG}$ at the transistor M1 caused by the data current $I_{DATA}$. Since the power supply voltages VDD1*a*, VDD1*b* at the sources of the transistors M1 and M2 are the same, the gate voltage at the transistor M2 caused by the precharge current $MI_{DATA}$ corresponds to the gate voltage at the transistor M1 caused by the data current $I_{DATA}$. Therefore, the signal line X1 can be charged with the precharge current $MI_{DATA}$ as a voltage corresponding to the data current $I_{DATA}$.

As described above, it takes time to charge the signal line X1 with a voltage corresponding to the data current $I_{DATA}$ according to the precharge current $MI_{DATA}$ because of the parasitic capacitance component formed in the signal line X1. However, because precharge current $MI_{DATA}$ is a current that is M times greater than the data current $I_{DATA}$, the signal line X1 may be charged within a time that is shorter than the time for charging the signal line X1 with the data current $I_{DATA}$. Accordingly, the signal line X1 can be charged with a voltage that is close to a voltage corresponding to the data current $I_{DATA}$ when the precharge time is short.

Referring to FIGS. 12B and 13, the additional current $(M-1)I_{DATA}$ is intercepted from the data driver 500, and concurrently, the switch Sd is turned off and the switches Sa, Sb, and Sc (i.e., the switch S1 of FIG. 10) are turned on during the sampling period Ts1. The data current $I_{DATA}$ provided from the signal line X1 is transmitted to the drain of the transistor M1. This causes the capacitor Ch to be charged with the source-gate voltage $V_{SG}$ of the transistor M1 given in Equation 1. In particular, since the precharge voltage close to the data current $I_{DATA}$ is applied to the signal line X1 according to the precharge operation, the capacitor Ch is quickly charged with a voltage corresponding to the data current $I_{DATA}$ even when the signal line X1 has a parasitic capacitance component. In this manner, a precharge operation for one sample/hold circuit 410 has been exemplified. The precharge operation can be performed before a sampling operation of the sample/hold circuits 430, 440, 410, and 420 which sequentially perform sampling in the demultiplexer 401. That is, according to the embodiment illustrated in FIG. 13, the time periods T1, T2, T3, and T4 can be divided into precharge periods Tp1, Tp2, Tp3, and Tp4, and sampling periods Ts1, Ts2, Ts3, and Ts4. This allows data current $I_{DATA}$ to be sampled in a relatively short period of time since the signal line $X_1$ is precharged with a voltage which is close to a voltage corresponding to the data current $I_{DATA}$ before the respective sample/hold circuits 410, 420, 430, and 440 sample the data current $I_{DATA}$.

The mechanism for precharging the signal lines X1 to Xn/N between the data driver 500 and the demultiplexer unit 400 in the display device according to the second embodiment has been described. The signal lines X1 to Xn/N can also be precharged via another mechanism, which will now be described according to a third exemplary embodiment.

Figure 14:
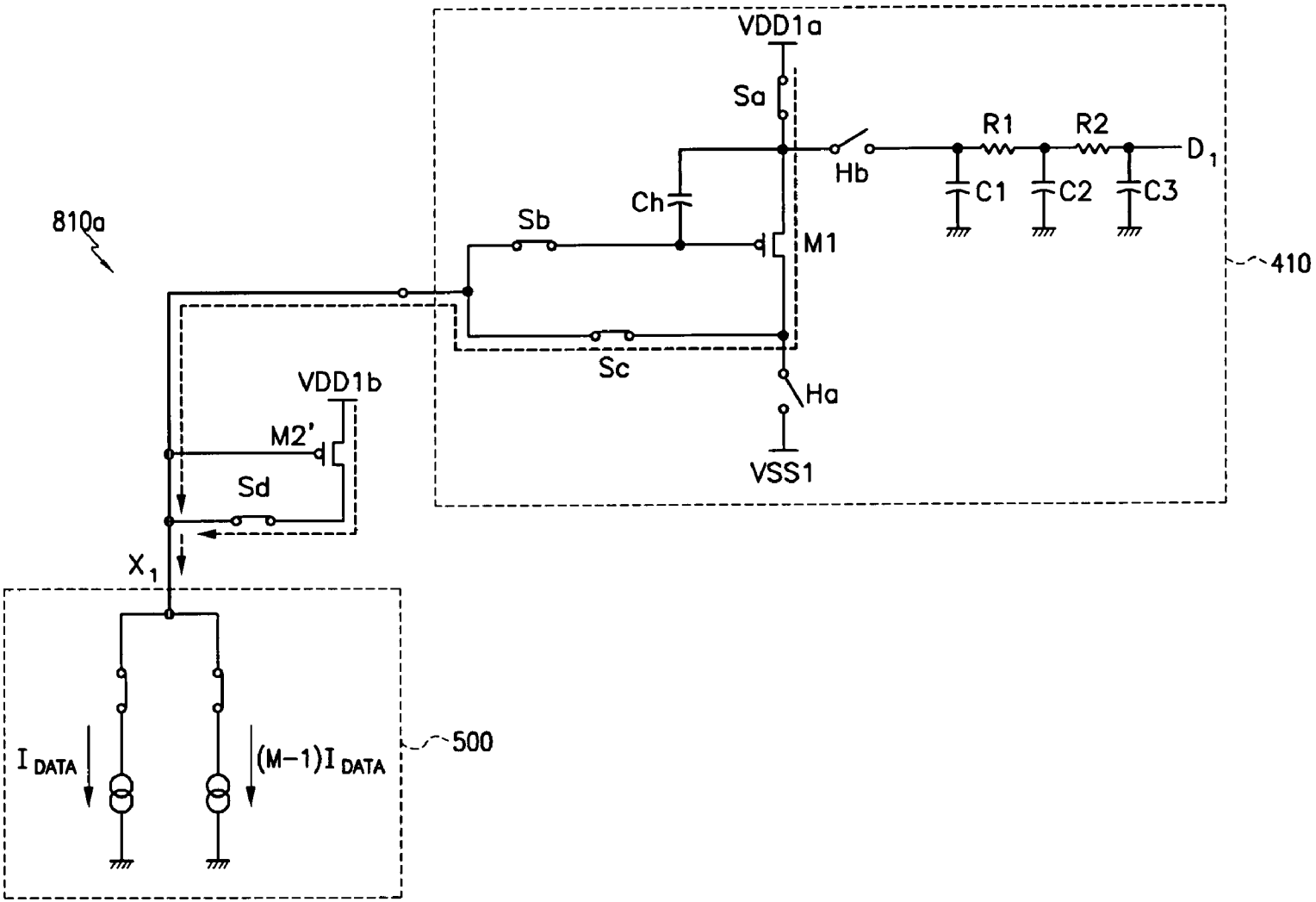
FIG. 14 shows an operation of a precharge circuit and sample/hold circuit according to a third exemplary embodiment of the present invention.
Figure 15:
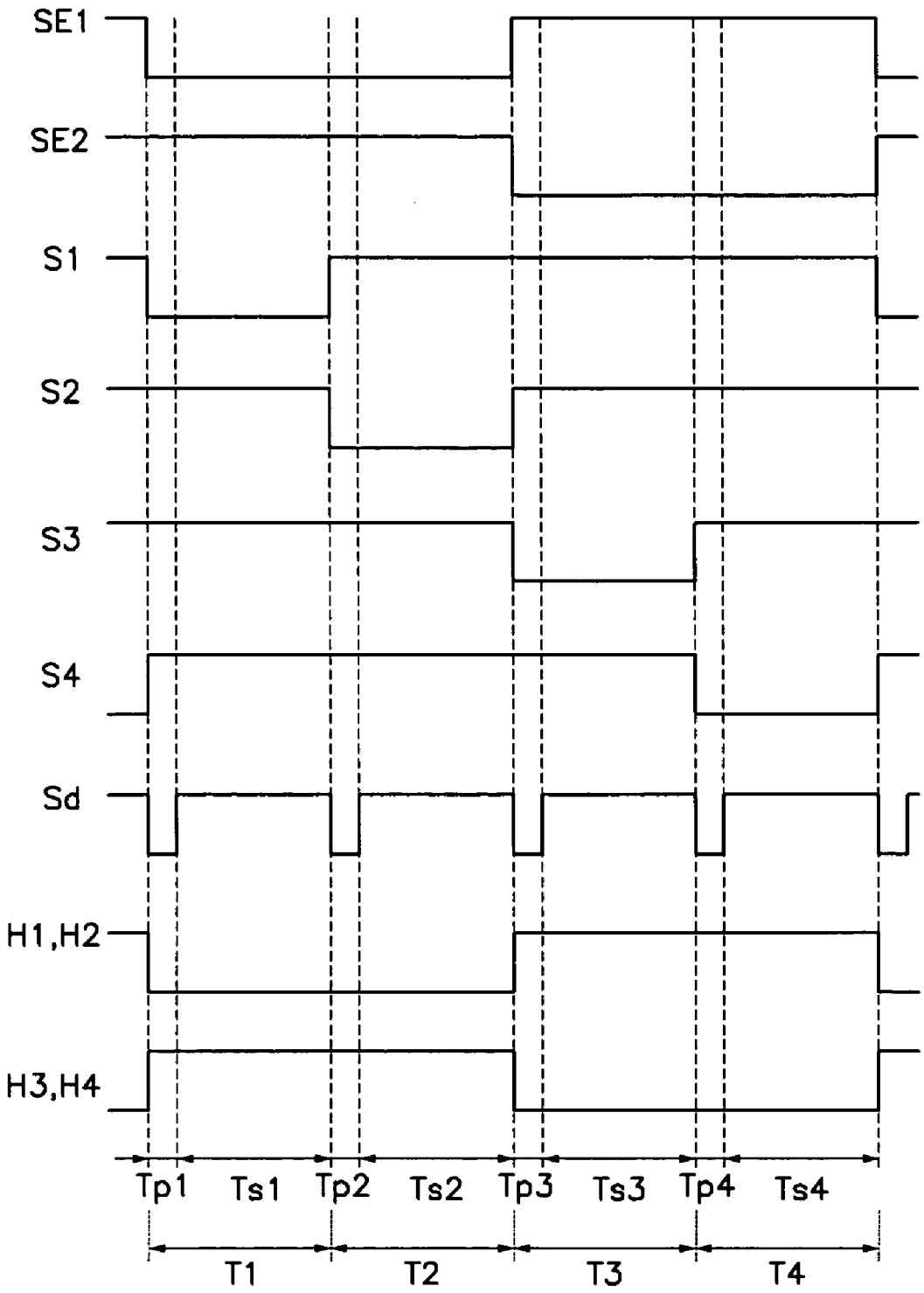
FIG. 15 shows a driving timing diagram for operating a precharge circuit and a sample/hold circuit according to a third exemplary embodiment of the present invention.

FIG. 14 shows an operation of a precharge circuit 810*a* according to the third exemplary embodiment of the present invention. FIG. 15 shows a driving timing diagram for operating the precharge circuit 810*a* according to the third exemplary embodiment of the present invention. As illustrated in FIG. 15, the switch Sd and the sampling switches S1, S2, S3, and S4, that is, the switches Sa, Sb, and Sc are turned on when the control signal level is low, and the holding switches H1, H2, H3, and H4, that is, the switches Ha and Hb are turned on when the control signal level is high.

The precharge mechanism according to the third embodiment uses circuits similar to the circuits illustrated in FIGS. 10 and 11. Transistor M2' in precharge circuit 810*a* has a ratio W2/L2 of the channel width to the channel length which is (M−1) times a ratio W1/L1 of the channel width to the channel length of the transistor M1. According to this embodiment, sampling switches Sa, Sb, and Sc are turned on during the precharge periods Tp1, Tp2, Tp3, and Tp4.

Referring to FIGS. 14 and 15, the switches Sa, Sb, and Sc (i.e., the sampling switch S1 of FIG. 10) and the switch Sd are turned on in response to the control signal and the transistors M1 and M2' are respectively diode-connected during a precharge period Tp1. The data current $I_{DATA}$ and the additional current $(M-1)I_{DATA}$ are concurrently applied to the signal line X1 from the data driver 500. Since the ratio W2/L2 of the channel width to the channel length of the transistor M2 is (M−1) times the ratio W1/L1 of the channel width to the channel length of the transistor M1, the current $(M-1)I_{DATA}$ is transmitted to the drain of the transistor M2', and the current $I_{DATA}$ is transmitted to the drain of the transistor M1. As a result, the signal line X1 is charged with a voltage that is close to a voltage corresponding to the data current $I_{DATA}$. The sample/hold circuit 410 performs sampling during the precharge period Tp1.

During the sampling period Ts1, the switch Sd is turned off and the additional current $(M-1)I_{DATA}$ is intercepted from the data driver 500 in response to the control signal. As in the embodiment illustrated in FIG. 12B, the voltage corresponding to data current $I_{DATA}$ provided from signal line X1 is charged in capacitor Ch.

When predetermined initial periods of periods T1, T2, T3, and T4 are established to be the precharge periods Tp1, Tp2, Tp3, and Tp4, the signal line X1 is precharged with a voltage which is close to a voltage corresponding to the data current $I_{DATA}$ before the respective sample/hold circuits 430, 440, 410, and 420 sample the data current $I_{DATA}$.

Figure 16:
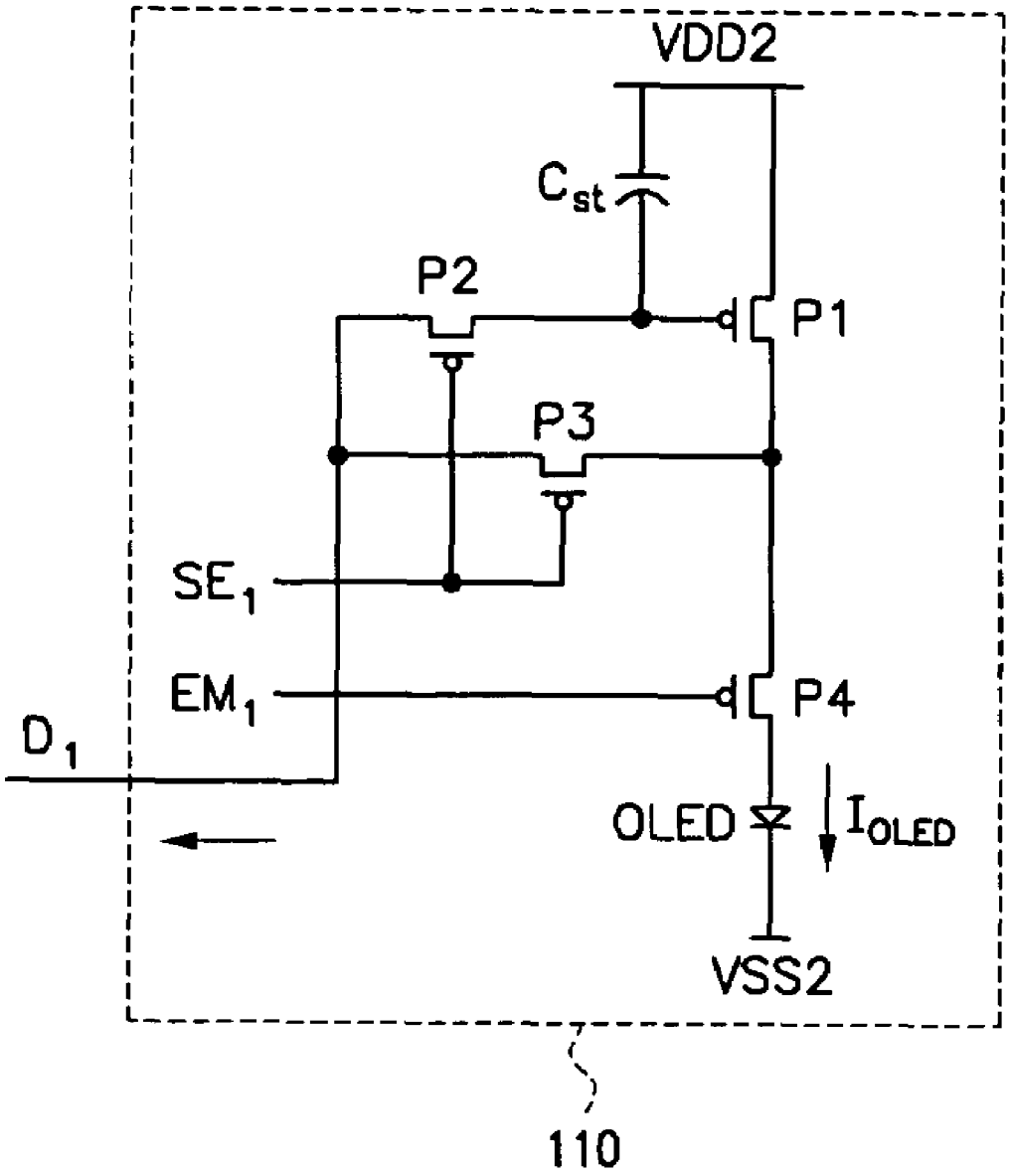
FIG. 16 shows a simplified circuit diagram of a pixel circuit.

Referring to FIG. 16, a pixel circuit formed at the pixel area of the display device according to the first to third embodiments will be described. FIG. 16 shows a simplified circuit diagram of the pixel circuit.

As shown, the pixel circuit 110 is coupled to the data line D1, and the data is programmed to the pixel circuit 110 by the current. According to one embodiment, pixel circuit 110 uses an electroluminescent light emission of organic matter. The pixel circuit 110 includes four transistors P1, P2, P3, and P4, a capacitor Cst, and a light emitting element OLED such as, for example, an organic light emitting diode. The transistors P1, P2, P3, and P4 in FIG. 16 are illustrated to be p-channel FETS.

The source of the transistor P1 is coupled to a power supply voltage VDD2, and the capacitor Cst is coupled between the source and the gate of the transistor P1. The transistor P2 is coupled between the data line D1 and the gate of the transistor P1 and responds to a select signal provided from the select scan line SE1. The transistor P3 is coupled between the drain of the transistor P1 and the data line D1, and diode-connects the transistors P1 and P2 in response to the select signal provided from the select scan line SE1. The transistor P4 is coupled between the drain of the transistor P1 and the light emitting element OLED, and transmits the current provided from the transistor P1 to the light emitting element OLED in response to an emit signal provided from the emit scan line EM1. A cathode of the light emitting element OLED is coupled to a power supply voltage VSS2 which is less than the power supply voltage VDD2.

In this instance, when the transistors P2 and P3 are turned on by the select signal provided from the select scan line SE1, the current provided from the data line D1 flows to the drain of the transistor P1, and the source-gate voltage of the transistor P1 corresponding to the current is stored in the capacitor Cst. When an emit signal is applied from the emit scan line EM1, the transistor P4 is turned on, the current $I_{OLED}$ of the transistor P1 corresponding to the voltage stored in the capacitor Cst is supplied to the light emitting element OLED, and the light emitting element OLED accordingly emits light.

According to one embodiment, the voltage drop in the vertical line V1 is reduced since the power supply voltage VDD2 is supplied by the vertical line V1 in the pixel circuit, and the power lines 600 and 700 for transmitting voltages to the vertical line V1 are formed on the top and the bottom of the display area.

The demultiplexer unit has been described to perform 1:2 demultiplexing. However, a person of skill in the art will recognize that demultiplexer units for performing 1:N demultiplexing may also be employed. Also, the power supply voltage VDD1*a* of the sample/hold circuits has been described to be supplied from the vertical lines V1 to Vn coupled to the power line 700. However, the power supply voltage VDD1*a* can be supplied from different lines other than the vertical lines V1 to Vn coupled to the power line 700. Further, the driving mechanism described in the second and third embodiments may be applied to situations where the power line 700 is not coupled to the vertical lines V1 to Vn.

According to the present invention, the voltage drop generated in the vertical lines is reduced by additionally providing a power line for supplying a power supply voltage in the display device using a demultiplexer, and the data current is sampled within the given time by precharging the signal line provided between the demultiplexer and the data driver.

While this invention has been described in connection with what is presently considered to be the practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a display device including a plurality of pixel circuits coupled to a plurality of data lines for transmitting data currents for displaying an image, and a plurality of signal lines each corresponding to at least two of the plurality of data lines and transmitting currents corresponding to the data currents corresponding to the at least two of the plurality of data lines, the method comprising:

applying a first precharge current to one of the plurality of signal lines;

applying to said one of the plurality of signals lines a first current corresponding to the data current to be applied to a corresponding first data line from the at least two data lines;

applying a second precharge current to said one of the plurality of signal lines;

applying to said one of the plurality of signals lines a second current corresponding to the data current to be applied to a corresponding second data line from the at least two data lines; and applying the data currents corresponding to the first and second currents to the corresponding first and second data lines, wherein the first precharge current is M times the first current and the second precharge current is M times the second current, where M is a real number greater than 1.

2. The method of claim 1 further comprising:

invoking a first sample/hold circuit for sampling the first current, the first sample/hold circuit being coupled between said one of the plurality of signal lines and the corresponding first data line; and invoking a second sample/hold circuit for sampling the second current, the second sample/hold circuit being coupled between said one of the plurality of signal lines and the corresponding second data line.

3. The method of claim 2, wherein the first precharge current is transmitted to a precharge circuit coupled to said one of the plurality of signal lines when the first precharge current is applied to said one of the plurality of signal lines, and the second precharge current is transmitted to the precharge circuit when the second precharge current is applied to said one of the plurality of signal lines.

4. The method of claim 3, wherein the precharge circuit comprises a first transistor having a gate and a drain coupled to said one of the plurality of signal lines, the first sample/hold circuit comprises a second transistor having a gate and a drain coupled to said one of the plurality of signal lines when the first current is applied, the second sample/hold circuit comprises a third transistor having a gate and a drain coupled to said one of the plurality of signal lines when the second current is applied, and a ratio W1/L1 of the first transistor is about M times a ratio W2/L2 of the second and third transistors, where W1 and L1 are respectively a channel width and a channel length of the first transistor, and W2 and L2 are respectively a channel width and a channel length of the second and third transistors.

5. The method of claim 3, wherein the first precharge current transmitted to the precharge circuit coupled to said one of the plurality of signal lines is (M−1) times the first current, and the first current is transmitted to the first sample/ hold circuit responsive to the first precharge current being applied to said one of the plurality of first signal lines; and the second precharge current transmitted to the precharge circuit is (M−1) times the second current, and the second current is transmitted to the second sample/hold circuit responsive to the second precharge current being applied to said one of the plurality of signal lines.

6. The method of claim 5, wherein the precharge circuit comprises a first transistor having a gate and a drain coupled to said one of the plurality of signal lines, the first sample/hold circuit comprises a second transistor having a gate and a drain coupled to said one of the plurality of signal lines when the first precharge current and the first current are applied, the second sample/hold circuit comprises a third transistor having a gate and a drain coupled to said one of the plurality of signal lines when the second precharge current and the second current are applied, and a ratio W1/L1 of the first transistor is about (M−1) times a ratio W2/L2 of the second and third transistors, where W1 and L1 are respectively a channel width and a channel length of the first transistor, and W2 and L2 are respectively a channel width and a channel length of the second and third transistors.

7. The method of claim 4, wherein substantially the same power supply voltages are supplied to sources of the first, second, and third transistors.

8. The method of claim 1, wherein each of the plurality of pixel circuits stores a voltage corresponding to the corresponding data current and emits light according to a current corresponding to the stored voltage.

9. The method of claim 8, wherein the light emission uses electroluminescent light emission of organic matter.

10. A display device comprising:

a display area including a plurality of pixel circuits coupled to a plurality of data lines for transmitting data currents for displaying an image;

a plurality of first signal lines;

a data driver coupled to the first signal lines for transmitting multiplexed currents corresponding to the data currents to the first signal lines;

a demultiplexer unit including a plurality of demultiplexers for demultiplexing the multiplexed currents, each said demultiplexer for transmitting corresponding said data currents to at least two of said data lines; and a precharge unit for transmitting precharge currents associated with the multiplexed currents to the first signal lines in response to a control signal before the multiplexed currents are transmitted to the first signal lines.

11. The display device of claim 10, wherein at least one of the plurality of demultiplexers comprises a plurality of sample/hold circuits coupled to a corresponding one of said first signal lines, and wherein during a particular horizontal period, sample/hold circuits of one group from among the plurality of sample/hold circuits hold the data currents corresponding to a corresponding said multiplexed current sampled during a previous horizontal period to the at least two said data lines while sample/hold circuits of another group sequentially sample the corresponding said multiplexed current applied through the corresponding said first signal line.

12. The display device of claim 11, wherein first and third sample/hold circuits form the sample/hold circuits of the one group, and second and fourth sample/hold circuits form the sample/hold circuits of the other group, the first and second sample/hold circuits having input terminals coupled to the corresponding one of said first signal lines and output terminals coupled to a first of the at least two said data lines, and the third and fourth sample/hold circuits having input terminals coupled to the corresponding one of said first signal lines and output terminals coupled to a second of the at least two said data lines.

13. The display device of claim 11, wherein each of the plurality of sample/hold circuits comprises a sampling switch being turned on in response to a sampling signal, a holding switch being turned on in response to a holding signal, and a data storage element, each of the plurality of sample/hold circuits sampling the corresponding said multiplexed current when the sampling switch is turned on and holding the data currents corresponding to the corresponding said multiplexed current sampled when the holding switch is turned on, and wherein the sampling signal is sequentially applied to each of the plurality of sample/hold circuits.

14. The display device of claim 13, wherein the data storage element comprises:

a first transistor having a source coupled to a first power source and a gate and a drain coupled to the corresponding one of said first signal lines in response to the sampling signal; and a first capacitor coupled between the gate and the source of the first transistor for storing a voltage corresponding to the data currents corresponding to the corresponding said multiplexed current transmitted to the gate and the drain.

15. The display device of claim 14, wherein the precharge unit comprises a second transistor having a source coupled to the first power source, and a gate and a drain coupled to the corresponding one of said first signal lines in response to the control signal.

16. The display device of claim 14, wherein the sampling switch comprises a first switch coupled between the gate of the first transistor and the corresponding one of said first signal lines, a second switch for diode-connecting the first transistor in response to the sampling signal, and a third switch coupled between the first power source and the source of the first transistor, and the holding switch comprises a fourth switch coupled between the drain of the first transistor and a second power source, and a fifth switch coupled between an output terminal of the sample/hold circuit and the first transistor.

17. The display device of claim 15, wherein the sampling signal is applied substantially concurrently with interception of the control signal, the precharge current is about M times the corresponding said multiplexed current, where M is a real number greater than 1, and a ratio W2/L2 of the second transistor is about M times a ratio W1/L1 of the first transistor, where W1 and W2 are channel widths of respectively the first and second transistors, and L1 and L2 are channel lengths of respectively the first and second transistors.

18. The display device of claim 15, wherein the sampling signal is applied substantially concurrently with the control signal, and the control signal is subsequently intercepted while the sampling signal is applied, the precharge current is about M times the corresponding said multiplexed current, where M is a real number greater than 1, and a ratio W2/L2 of the second transistor is about (M−1) times a ratio W1/L1 of the first transistor, where W1 and W2 are channel widths of respectively the first and second transistors, and L1 and L2 are channel lengths of respectively the first and second transistors.

19. The display device of claim 17, wherein the first and second transistors are transistors having a same conductive type.

20. The display device of claim 1, wherein the display area comprises a plurality of second signal lines for supplying power supply voltages to the plurality of pixel circuits, and the display device further comprises a power line formed between the demultiplexer unit and the data driver and crossing the first signal lines in a manner insulated from the first signal lines for transmitting the power supply voltages provided from the second signal lines.

21. The display device of claim 20, wherein the first power source is coupled to the power line.

22. The display device of claim 1, wherein the precharge unit is formed between the demultiplexer unit and the data driver.

23. The display device of claim 1, wherein each of the plurality of pixel circuits comprises a capacitor for storing a voltage corresponding to one of said data currents transmitted through a corresponding one of said data lines, a third transistor, having a source and a gate coupled to the second capacitor, the third transistor being the transistor to which current corresponding to the voltage stored in the capacitor flows, and a light emitting element for emitting light corresponding to the current of the third transistor.

24. The display device of claim 23, wherein the light emitting element uses electroluminescent light emission of organic matter.

25. A display device comprising:

a display area including first and second pixel circuits respectively coupled to first and second data lines;

a signal line;

a first circuit coupled between the signal line and the first data line for holding a first data current for displaying an image to the first data line;

a second circuit, coupled between the signal line and the second data line for holding a second data current for displaying the image to the second data line;

a data driver coupled to the signal line for sequentially transmitting to the signal line first and second currents respectively corresponding to the first and second data currents; and a precharge unit coupled to the signal line for transmitting a first precharge current to the signal line before the first current is applied to the signal line, and transmitting a second precharge current to the signal line before the second current is applied to the signal line;

wherein the first and second circuits respectively sample the first and second currents during a single horizontal period, and concurrently hold the first and second data currents respectively corresponding to the first and second currents during a subsequent horizontal period.

26. The display device of claim 25, wherein the first precharge current is M times the first current and the second precharge current is M times the second current, where M is a real number greater than 1.

* * * * *